US008613676B2

(12) United States Patent
Bentley

(10) Patent No.: US 8,613,676 B2
(45) Date of Patent: Dec. 24, 2013

(54) HANDLE INTEGRATED MOTION CAPTURE ELEMENT MOUNT

(75) Inventor: Michael Bentley, Encinitas, CA (US)

(73) Assignee: Blast Motion, Inc., Burlingame, CA (US)

( * ) Notice: Subject to any disclaimer, the term of this patent is extended or adjusted under 35 U.S.C. 154(b) by 25 days.

(21) Appl. No.: 13/358,522

(22) Filed: Jan. 26, 2012

(65) Prior Publication Data

US 2012/0120573 A1 May 17, 2012

Related U.S. Application Data

(63) Continuation-in-part of application No. 13/306,869, filed on Nov. 29, 2011, and a continuation-in-part of application No. 13/351,429, filed on Jan. 17, 2012, which is a continuation-in-part of application No. 13/298,158, filed on Nov. 16, 2011, which is a continuation-in-part of application No. 13/267,784, filed on Oct. 6, 2011, which is a continuation-in-part of application No. 13/219,525, filed on Aug. 26, 2011, which is a continuation-in-part of application No. 13/191,309, filed on Jul. 26, 2011, which is a continuation-in-part of application No. 13/048,850, filed on Mar. 15, 2011, now Pat. No. 8,465,376, which is a continuation-in-part of application No. 12/901,806, filed on Oct. 11, 2010, which is a continuation-in-part of application No. 12/868,882, filed on Aug. 26, 2010.

(51) Int. Cl.
*A63B 57/00* (2006.01)

(52) U.S. Cl.
USPC ..... 473/221; 473/219; 473/222; 473/316; 473/407

(58) Field of Classification Search
USPC ..... 473/219–222, 316, 407
See application file for complete search history.

(56) References Cited

U.S. PATENT DOCUMENTS 3,223,555 A * 12/1965 Himy et al. ..... 429/129
3,606,327 A * 9/1971 Gorman ..... 73/297

(Continued)

FOREIGN PATENT DOCUMENTS

CA 2694123 8/2011
KR 20070120443 12/2007

(Continued)

OTHER PUBLICATIONS myCaddie, 2009, retrieved on Sep. 26, 2012 from http://www.iMakePars.com, 4 pages.

(Continued)

*Primary Examiner* — Lawrence Galka
(74) *Attorney, Agent, or Firm* — ARC IP Law, PC; Joseph J. Mayo

(57) ABSTRACT

Handle integrated motion capture element mount that enables coupling or retrofitting a golf club with active motion capture electronics that are battery powered, passive or active shot count components, for example a passive RFID, and/or a visual marker on the cap for use with visual motion capture cameras. Does not require modifying the golf club. Electronics package and battery can be easily removed and replaced, for example without any tools. May utilize a weight that is removed when inserting the electronic package in the mount, wherein the weight element may have the same weight as an electronics package, for no net change or minimal change in club weight. May be implemented with a handle without electronics for future upgrading. May utilize non-permanently and/or friction coupling between the mount and equipment.

17 Claims, 28 Drawing Sheets

(56) References Cited

U.S. PATENT DOCUMENTS

| | | | | |
|---|---|---|---|---|
| 4,898,389 | A | 2/1990 | Plutt | |
| 4,910,677 | A | 3/1990 | Remedio et al. | |
| 4,940,236 | A | 7/1990 | Allen | |
| 5,086,390 | A | 2/1992 | Matthews | |
| 5,127,044 | A | 6/1992 | Bonito et al. | |
| 5,230,512 | A | 7/1993 | Tattershall | |
| 5,259,620 | A * | 11/1993 | Marocco | 473/224 |
| 5,283,733 | A | 2/1994 | Colley | |
| 5,298,904 | A | 3/1994 | Olich | |
| 5,332,225 | A * | 7/1994 | Ura | 473/223 |
| 5,364,093 | A | 11/1994 | Huston et al. | |
| 5,372,365 | A | 12/1994 | McTeigue et al. | |
| 5,422,798 | A * | 6/1995 | Osiecki et al. | 362/206 |
| 5,441,269 | A | 8/1995 | Henwood | |
| 5,486,001 | A | 1/1996 | Baker | |
| 5,524,081 | A | 6/1996 | Paul | |
| 5,542,676 | A * | 8/1996 | Howe et al. | 473/202 |
| 5,626,527 | A | 5/1997 | Eberlein | |
| 5,632,484 | A * | 5/1997 | Lambert | 473/241 |
| 5,665,006 | A | 9/1997 | Pellegrini | |
| 5,792,001 | A | 8/1998 | Henwood | |
| 5,800,279 | A * | 9/1998 | Densberger et al. | 473/220 |
| 5,819,206 | A | 10/1998 | Horton | |
| 5,973,596 | A | 10/1999 | French et al. | |
| 6,007,439 | A | 12/1999 | MacKay, Jr. | |
| 6,030,109 | A | 2/2000 | Lobsenz | |
| 6,248,021 | B1 | 6/2001 | Ognjanovic | |
| 6,443,860 | B1 | 9/2002 | Byrne et al. | |
| 6,456,938 | B1 | 9/2002 | Barnard | |
| 6,582,328 | B2 | 6/2003 | Kuta et al. | |
| 6,697,820 | B1 | 2/2004 | Tarlie | |
| 6,705,942 | B1 | 3/2004 | Crook et al. | |
| 6,709,352 | B1 | 3/2004 | Albin | |
| 6,746,336 | B1 | 6/2004 | Brant et al. | |
| 6,757,572 | B1 | 6/2004 | Forest | |
| 6,802,772 | B1 | 10/2004 | Kunzle et al. | |
| 6,900,759 | B1 | 5/2005 | Katayama | |
| 6,908,404 | B1 | 6/2005 | Gard | |
| 6,923,729 | B2 | 8/2005 | McGinty et al. | |
| 7,004,848 | B2 | 2/2006 | Konow | |
| 7,021,140 | B2 | 4/2006 | Perkins | |
| 7,037,198 | B2 | 5/2006 | Hameen-Anttila | |
| 7,118,498 | B2 | 10/2006 | Meadows et al. | |
| 7,121,962 | B2 | 10/2006 | Reeves | |
| 7,143,639 | B2 | 12/2006 | Gobush | |
| 7,160,200 | B2 | 1/2007 | Grober | |
| 7,175,177 | B2 | 2/2007 | Meifu et al. | |
| 7,234,351 | B2 | 6/2007 | Perkins | |
| 7,264,098 | B2 | 9/2007 | McPherson | |
| 7,267,619 | B1 * | 9/2007 | Pettis | 473/297 |
| 7,433,805 | B2 | 10/2008 | Vock et al. | |
| 7,457,439 | B1 | 11/2008 | Madsen | |
| 7,457,724 | B2 | 11/2008 | Vock et al. | |
| 7,481,716 | B1 * | 1/2009 | Johnson | 473/297 |
| 7,494,236 | B2 | 2/2009 | Lim | |
| 7,623,987 | B2 | 11/2009 | Vock et al. | |
| 7,689,378 | B2 | 3/2010 | Kolen | |
| 7,813,887 | B2 | 10/2010 | Vock et al. | |
| 7,966,154 | B2 | 6/2011 | Vock et al. | |
| 7,983,876 | B2 | 7/2011 | Vock et al. | |
| 8,036,826 | B2 | 10/2011 | Macintosh et al. | |
| 8,117,888 | B2 | 2/2012 | Chan et al. | |
| 8,172,722 | B2 | 5/2012 | Molyneux et al. | |
| 8,231,506 | B2 | 7/2012 | Molyneux et al. | |
| 8,249,831 | B2 | 8/2012 | Vock et al. | |
| 8,257,191 | B2 | 9/2012 | Stites et al. | |
| 8,348,783 | B2 * | 1/2013 | Soracco et al. | 473/296 |
| 8,355,529 | B2 | 1/2013 | Wu et al. | |
| 8,525,292 | B2 | 9/2013 | Cheng et al. | |
| 2001/0035880 | A1 | 11/2001 | Musatov et al. | |
| 2001/0045904 | A1 | 11/2001 | Silzer, Jr. | |
| 2002/0004723 | A1 | 1/2002 | Meifu et al. | |
| 2002/0019677 | A1 | 2/2002 | Lee | |
| 2002/0049507 | A1 | 4/2002 | Hameen-Anttila | |
| 2002/0052750 | A1 | 5/2002 | Hirooka | |
| 2002/0072815 | A1 | 6/2002 | McDonough et al. | |
| 2002/0082775 | A1 | 6/2002 | Meadows et al. | |
| 2002/0151994 | A1 | 10/2002 | Sisco | |
| 2002/0173364 | A1 | 11/2002 | Boscha | |
| 2002/0177490 | A1 | 11/2002 | Yong et al. | |
| 2002/0188359 | A1 | 12/2002 | Morse | |
| 2003/0008722 | A1 | 1/2003 | Konow | |
| 2004/0147329 | A1 | 7/2004 | Meadows et al. | |
| 2004/0224787 | A1 * | 11/2004 | Lindner | 473/316 |
| 2004/0248676 | A1 | 12/2004 | Taylor et al. | |
| 2005/0215340 | A1 | 9/2005 | Stites et al. | |
| 2005/0261073 | A1 | 11/2005 | Farrington, Jr. et al. | |
| 2005/0268704 | A1 | 12/2005 | Bissonnette et al. | |
| 2005/0272516 | A1 | 12/2005 | Gobush | |
| 2005/0282650 | A1 | 12/2005 | Miettinen et al. | |
| 2006/0063600 | A1 | 3/2006 | Grober | |
| 2006/0084516 | A1 | 4/2006 | Eyestone et al. | |
| 2006/0109116 | A1 | 5/2006 | Keays | |
| 2006/0122002 | A1 | 6/2006 | Konow | |
| 2006/0199659 | A1 | 9/2006 | Caldwell | |
| 2006/0270450 | A1 | 11/2006 | Garratt et al. | |
| 2006/0276256 | A1 | 12/2006 | Storek | |
| 2007/0081695 | A1 | 4/2007 | Foxlin et al. | |
| 2007/0087866 | A1 | 4/2007 | Meadows et al. | |
| 2007/0111811 | A1 | 5/2007 | Grober | |
| 2007/0129178 | A1 | 6/2007 | Reeves | |
| 2007/0135225 | A1 | 6/2007 | Nieminen | |
| 2007/0135237 | A1 | 6/2007 | Reeves | |
| 2007/0270214 | A1 | 11/2007 | Bentley | |
| 2007/0298896 | A1 | 12/2007 | Nusbaum | |
| 2009/0111602 | A1 * | 4/2009 | Savarese et al. | 473/283 |
| 2009/0177097 | A1 | 7/2009 | Ma et al. | |
| 2009/0209358 | A1 | 8/2009 | Niegowski | |
| 2009/0233735 | A1 * | 9/2009 | Savarese et al. | 473/407 |
| 2010/0049468 | A1 | 2/2010 | Papadourakis | |
| 2010/0063778 | A1 | 3/2010 | Schrock et al. | |
| 2010/0063779 | A1 | 3/2010 | Schrock et al. | |
| 2010/0091112 | A1 | 4/2010 | Veeser et al. | |
| 2010/0130298 | A1 | 5/2010 | Dugan et al. | |
| 2010/0144456 | A1 * | 6/2010 | Ahern | 473/222 |
| 2010/0216564 | A1 | 8/2010 | Stites et al. | |
| 2010/0222152 | A1 | 9/2010 | Jaekel et al. | |
| 2010/0308105 | A1 * | 12/2010 | Savarese et al. | 235/375 |
| 2011/0015005 | A1 | 1/2011 | Pfeifer | |
| 2011/0037778 | A1 | 2/2011 | Deng et al. | |
| 2011/0075341 | A1 | 3/2011 | Lau et al. | |
| 2011/0165998 | A1 | 7/2011 | Lau et al. | |
| 2011/0230273 | A1 | 9/2011 | Niegowski et al. | |
| 2011/0230274 | A1 | 9/2011 | Lafortune et al. | |
| 2011/0230985 | A1 | 9/2011 | Niegowski et al. | |
| 2011/0230986 | A1 | 9/2011 | Lafortune | |
| 2012/0115682 | A1 | 5/2012 | Homsi | |
| 2012/0120573 | A1 | 5/2012 | Bentley | |
| 2013/0060168 | A1 | 3/2013 | Chu et al. | |
| 2013/0167290 | A1 | 7/2013 | Ben Ezra | |

FOREIGN PATENT DOCUMENTS

| | | |
|---|---|---|
| KR | 10-1079319 | 11/2011 |
| WO | 94/27683 | 12/1994 |

OTHER PUBLICATIONS

Swing it See it Fix it, Improve Gold Swing, SwingSmart Golf Analyzer, retrieved on Sep. 26, 2012 from http://www.SwingSmart.com, 2 pages.

Learn how Swingbyte can improve your game, retrieved on Sep. 26, 2012 from http://www.swingbyte.com, 2 pages.

miCoach SPEED_CELL TM, User Manual, 23 pages.

Nike+iPod, User Guide, 32 pages.

SureShotGPS SS9000X, Intelligent Touch, Instruction Manual, 25 pages.

International Search Report Dated Mar. 29, 2013, 10 pages.

International Search Report Dated Jul. 18, 2013, 6 pages, PCT Appl. No. PCT/US2013/038694.

The Nike+FuelBand User's Guide, rev 14, 26 pages.

UP by Jawbone Extended User Guide, 10 pages.

(56) References Cited

OTHER PUBLICATIONS

Armour39, Under Armour Guarantee, Getting Started, retrieved from the Internet on Jul. 12, 2013, 7 pages.
Armour39 Module & Chest Strap, retrieved from the Internet on Jul. 12, 2013, 6 pages.
miCoach Pacer User Manual, 31 pages.
Foreman et al. "A Comparative Analysis for the Measurement of Head Accelerations in Ice Hockey Helmets using Non-Accelerometer Based Systems," Nov. 19, 2012, 13 pages.
ActiveReply, "TRACE—The Most Advanced Activity Monitor for Action Sports", http://www.kickstarter.com/projects/activereplay/trace-the-most-advanced-activity-monitor-for-actio, 13 pages, Jul. 31, 2013.

* cited by examiner 1B
100a
1B 104
103
102
105
101
1E 103
102
105

1111

101
102

HANDLE INTEGRATED MOTION CAPTURE ELEMENT MOUNT

This application is a continuation-in-part of U.S. Utility patent application Ser. No. 13/306,869 filed 29 Nov. 2011, and this application is also a continuation-in-part of U.S. Utility patent application Ser. No. 13/351,429 filed 17 Jan. 2012, which is a continuation-in-part of U.S. Utility patent application Ser. No. 13/298,158 filed 16 Nov. 2011, which is a continuation-in-part of U.S. Utility patent application Ser. No. 13/267,784 filed 6 Oct. 2011, which is a continuation-in-part of U.S. Utility patent application Ser. No. 13/219,525 filed 26 Aug. 2011, which is a continuation-in-part of U.S. Utility patent application Ser. No. 13/191,309 filed 26 Jul. 2011, which is a continuation-in-part of U.S. Utility patent application Ser. No. 13/048,850 filed 15 Mar. 2011, now U.S. Pat. No. 8,465,376 which is a continuation-in-part of U.S. Utility patent application Ser. No. 12/901,806 filed 11 Oct. 2010, which is a continuation-in-part of U.S. Utility patent application Ser. No. 12/868,882 filed 26 Aug. 2010, the specifications of which are all hereby incorporated herein by reference.

BACKGROUND OF THE INVENTION

1. Field of the Invention

One or more embodiments setting forth the ideas described throughout this disclosure pertain to the field of mounts as utilized in sporting equipment for electronics and visual markers. More particularly, but not by way of limitation, one or more aspects of the disclosure enable a handle integrated motion capture element mount.

2. Description of the Related Art

Known systems for mounting electronics on sporting equipment include mounts in the shafts of fishing poles, and golf clubs for example. Existing mounts have the following limitations:

- Existing mounts for sporting equipment electronics require alteration of an existing piece of sporting equipment before attaching the mount and hence electronics. For example, known mounts require modification of a golf club shaft to include threads.
- Some mounts extend longitudinally away from the normal ending point of the shaft for a distance that is far enough to interfere with or provide a confusing point at which to grasp the club.
- Other mounts combine the electronics on the mount itself in a monolithic package that does not allow for the weight of the club to remain constant with or without electronics installed. For example, in sports with rules against instrumented sporting equipment, the weight of an instrumented piece of sporting equipment differs from the weight of the same non-instrumented piece of sporting equipment that complies with competition rules.
- There are no known systems that include electronics within the shaft of a piece of sporting equipment that are also utilized to provide a visual marker for motion capture. Traditionally, mounts have been used for electronics or visual markers, but not both.

For at least the limitations described above there is a need for a handle integrated motion capture element mount.

BRIEF SUMMARY OF THE INVENTION

Embodiments of the invention enable a handle integrated motion capture element mount for a piece of sporting, exercise or medical rehabilitation equipment, for example a golf club, tennis racquet, weight training bar, or any other equipment capable of movement by a human. In addition, embodiments enable existing equipment that was not manufactured originally with a mount for electronics to be retrofitted with a motion capture element mount. The apparatus may be located within a shaft or grip in the handle portion of the equipment for example, or may replace the grip or handle portion of the equipment to provide a location in which to mount a motion capture element. In one or more embodiments, the grip may extend beyond the shaft and couple or aid in the coupling of the motion capture element with the shaft. One or more embodiments of the grip may include a grip that may roll down from the sides of a motion capture element to enable the motion capture element to be accessed without removing the grip from the shaft. The mount is configured to hold electronics and/or a visual marker. Embodiments of the invention do not require modifying the equipment, for example the golf club, to include threads within the shaft. The apparatus may be flush mounted with the normal end of the equipment or have any desired length of extension from the end of the equipment. The mount also allows for the battery to be easily removed and replaced, for example without any tools. Although the remainder of this disclosure refers to an exemplary piece of equipment such as a golf club, one skilled in the art will recognize that embodiments of the invention may be utilized in any type of equipment capable of coupling with the apparatus.

One or more embodiments of the non-integrated version of the mount include a shaft enclosure and expander that may be coupled with an attachment element, for example a screw that is aligned along an axis parallel to the axis of the golf club shaft. The shaft enclosure and expander are situated within the handle portion of a golf club and engage in inner portion of the golf club shaft or grip for example. In one or more embodiments, the screw is then rotated to move the shaft enclosure and expander together, which thus forces legs of the shaft enclosure in a direction orthogonal to the axis of the golf club shaft. The force of the shaft enclosure against the inner wall of the golf club shaft thus couples the shaft enclosure to the golf club shaft non- permanently, for example based on the coefficient of static friction therebetween. After the shaft enclosure and expander are brought close enough together via the attachment element to securely couple the mount to the golf club shaft or inside portion of a grip that is coupled to the golf club shaft, then either the electronics package or a weight element is coupled with the shaft enclosure. Embodiments of the weight element require no modification of the equipment. A cap is coupled with the shaft enclosure in either case, which provides a cover for the weight element or electronics package and which may include a visual marker and/or logo on the cap. Any other method or structure that enables a non-permanent mount of the apparatus that requires no modification of the golf club shaft is in keeping with the spirit of the invention.

Other integrated embodiments of the invention include a handle or grip configured to couple with a shaft of a piece of equipment wherein the handle provides a smooth outer surface and an inner volume configured to house a motion capture element and associated battery, electronics and cap for example. These embodiments generally do not make use of an expander and an attachment element coupled thereto as in the non-integrated embodiments that couple the mount onto the inner portion of the shaft for example of a piece of equipment. This is because one or more of the integrated embodiments are configured as a handle for example that couples with an outer portion of a shaft of a piece of sporting equipment. In this manner, the enclosure that houses a motion capture element and associated battery for example is an integral volume within the handle. By providing a slug weight of equal weight to the motion capture element, the exact same weight may be provided by the mount with or without a motion capture element attached within by switching the motion capture element for the slug weight and visa versa. This enables compliance with sporting rules for competitions that do not allow integrated electronics for example, while not compromising any physical difference in weight or torque of a piece of equipment for example as is described in more detail below.

One or more embodiments of the invention may be utilized in combination with a double battery assembly, optionally with dual power electrical tabs and high impact contacts that ensure that the motion capture element does not lose electrical contact under high impact. One or more embodiments of the dual battery embodiments may utilize a two-fold contact that effectively couples two batteries in parallel although they are stacked in what would normally be a series connection. In this manner, extended battery life is enabled without custom designed batteries, e.g., so that off-the-shelf batteries may be utilized.

If the electronics package is installed, then generally a positive battery contact, printed circuit board (PCB), an insulator or insulative spacer, with negative electrical contact and battery may be installed between the shaft enclosure and cap. The electronics that may be coupled with the PCB for example may include active motion capture electronics that are battery powered, passive or active shot count components, for example a passive or active radio frequency identification (RFID) tag. Embodiments of the electronics may include motion capture accelerometers and/or gyroscopes and/or an inertial measurement unit along with wireless transmitter/receiver or transceiver components. The RFID tag enables golf shots for each club associated with a golfer to be counted. Golf shots may optionally be counted via an identifier associated with motion capture electronics on the golf club in conjunction with a mobile computer, for example an IPHONE® equipped with an RFID reader that concentrates the processing for golf shot counting on the mobile computer instead of on each golf club. Optionally a wireless antenna may be coupled with the cap or alternatively may be implemented integral to the PCB as desired. One or more embodiments of the invention may also include a Global Positioning System (GPS) antenna. The GPS antenna may be mounted on the printed circuit board or may be located separate from the printed circuit board. One or more embodiments of the invention may also directly or indirectly communicate with any other sensors coupled with the club including motion analysis capture elements, strain gauges or any other type of sensor coupled for example with the golf club head. One or more embodiments of the invention may also utilize a battery coupling that attaches the battery to the shaft enclosure so that when the cap is removed, the battery does not fall out, unless intended. Embodiments may also utilized spring based electrical contacts to prevent loss of electrical conductivity under high acceleration.

As previously stated, one or more embodiments may include a weight element, or slug weight, that is interchangeable with the electronic package in the mount. The electronics package may be removed for example to comply with any sporting rules that do not allow instrumented sporting equipment. For example, USGA Rule 14-3 on Artificial Devices prohibits any "unusual device", for example under 14-3(b) "For the purpose of gauging or measuring distance". Any embodiment of the electronics package including a GPS receiver may thus be removed prior to match play for example and replaced with a weight element to minimize the weight difference. For example, the weight element may for example weigh close to or the same as the electronics to minimize overall instrumented versus non-instrumented weight differences of the golf club. In addition, a manufacture may provide the mount on each club with a small weight for example, that is removed when the golfer decides to upgrade the club to include active instrumented electronics or passive shot count elements that weigh the same amount. The net effect on the club dynamics for swing then is negligible. In one embodiment, the plastic portion of the mount weighs 5.7 grams and the battery weighs 3 grams while the screw weighs 1.9 grams. Thus the mounting components have minimal weight and by selecting a weight element of the same weight of the electronics package, or elements within the shaft enclosure and cap that are replaced by the weight element, the golfer feels no change in club weight when upgrading to an instrumented club.

The visual marker may be mounted on the cap for use with visual motion capture cameras. A golf club number may also be displayed on in a display area of the cap to indicate which club number is associated with the golf club. Embodiments of the visual marker may be passive or active, meaning that they may either have a visual portion that is visually trackable or may include a light emitting element such as a light emitting diode (LED) that allows for image tracking in low light conditions respectively. This for example may be implemented with a graphical symbol or colored marker at the cap of the mount on the shaft at the end of the handle for example. Motion analysis may be performed externally, for example using a camera and computer system based on the visual marker in any captured images. The visual data may also be utilized in motion analysis in combination with any wireless data from any installed electronics package.

BRIEF DESCRIPTION OF THE DRAWINGS

The above and other aspects, features and advantages of the ideas conveyed through this disclosure will be more apparent from the following more particular description thereof, presented in conjunction with the following drawings wherein.

DETAILED DESCRIPTION OF THE INVENTION

A handle integrated motion capture element mount will now be described. In the following exemplary description numerous specific details are set forth in order to provide a more thorough understanding of the ideas described throughout this specification. It will be apparent, however, to an artisan of ordinary skill that embodiments of ideas described herein may be practiced without incorporating all aspects of the specific details described herein. In other instances, specific aspects well known to those of ordinary skill in the art have not been described in detail so as not to obscure the disclosure. Readers should note that although examples of the innovative concepts are set forth throughout this disclosure, the claims, and the full scope of any equivalents, are what define the invention. Although this disclosure refers to an exemplary piece of equipment such as a golf club, one skilled in the art will recognize that embodiments of the invention may be utilized in any equipment capable of coupling with the apparatus. This includes any piece of sporting, exercise or medical rehabilitation equipment, for example a golf club, tennis racquet, weight training bar, or any other equipment capable of movement by a human.

Figure 1:
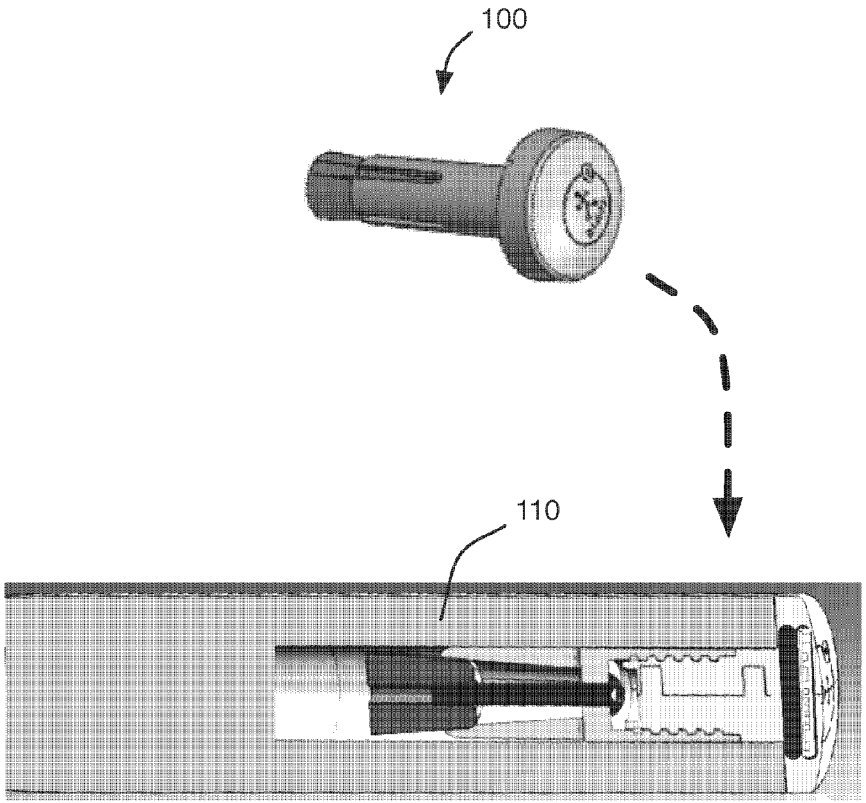
FIG. 1 illustrates a non-integrated embodiment of the invention alone in perspective view and as mounted in a golf club shaft as shown in cutaway view.

FIG. 1 illustrates a non-integrated embodiment of the invention 100 alone in perspective view and as mounted in a shaft of a piece of movement equipment, here golf club shaft 110 as shown in cutaway view. Embodiments enable a mount for a new golf club or that can be retrofitted in an existing golf club. The mount may be located in the handle portion of the shaft of the golf club, or for example within a grip that is to be attached to the golf club shaft, and is configured to hold electronics and/or a visual marker.

Figures 1A, 1B, 1C, 1D, 1G:
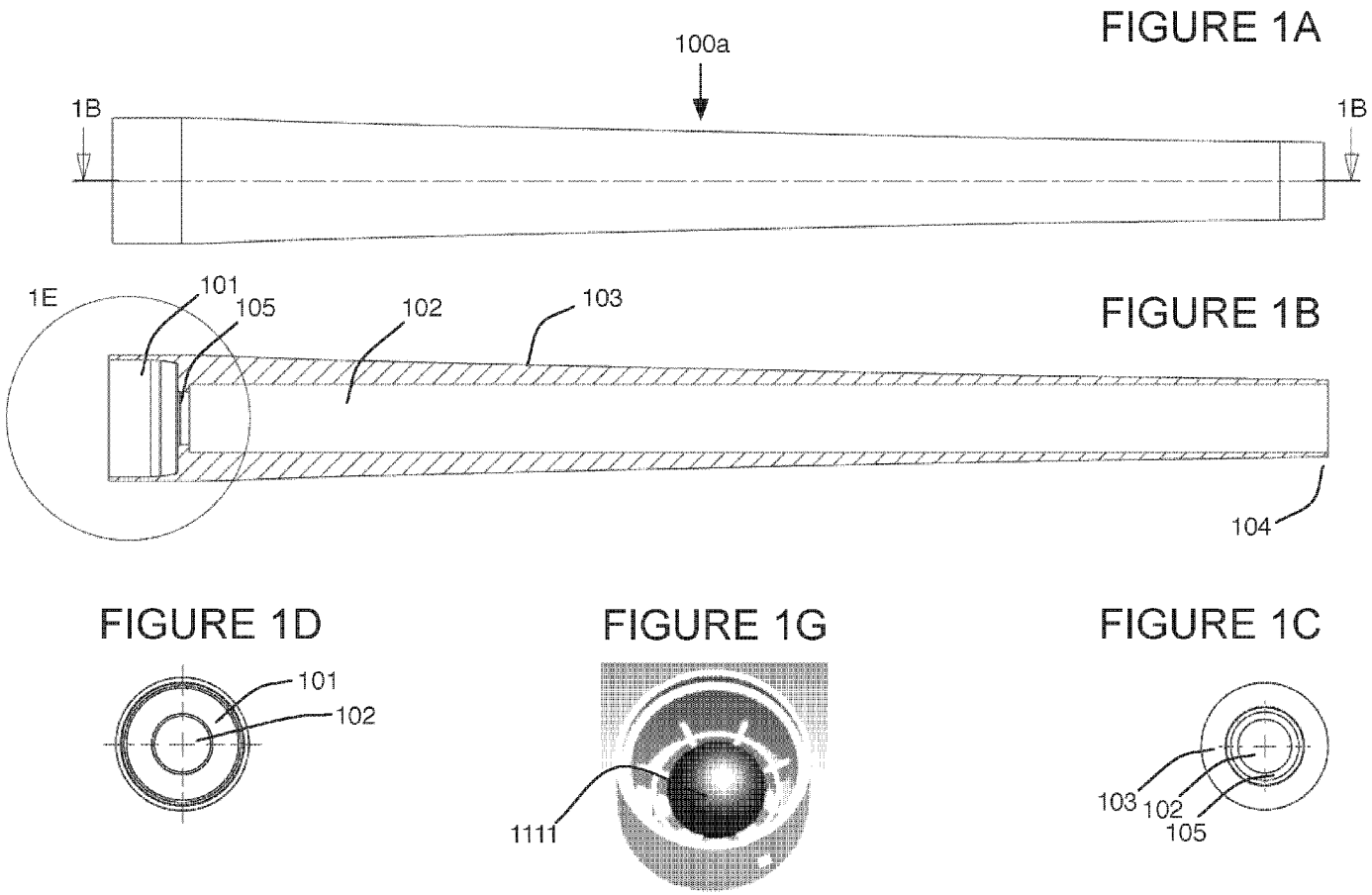
FIG. 1A illustrates a side view of an integrated embodiment of the invention configured as a handle that has a first hollow area configured to couple with a shaft of a piece of equipment and a second area configured as an enclosure to hold a motion capture element and battery or a slug weight of equal weight to the motion capture element and battery for example.
FIG. 1B illustrates a cutaway view of FIG. 1A showing the first and second areas that couple with the shaft and that hold the motion capture element and battery or slug weight.
FIG. 1C illustrates an end view of the integrated embodiment of the invention from the narrow end that is generally furthest away from the hands of a user.
FIG. 1D illustrates an end view of the integrated embodiment of the invention from the end configured to house the motion capture element and battery or slug weight.
FIG. 1G illustrates a perspective bottom view of the slug weight utilized with integrated and non-integrated embodiments of the invention to maintain an equivalent weight for the piece of equipment whether a motion capture element and batteries are installed or replaced with the slug weight for example.

FIG. 1A illustrates a side view of integrated embodiment of the invention 100*a* configured as a handle. As shown in FIG. 1B, which illustrates a cutaway view of FIG. 1A, the integrated embodiment includes first hollow area 102 configured to couple with a shaft of a piece of equipment and second area 101 configured as an enclosure to hold a motion capture element and battery or a slug weight of equal weight to the motion capture element and battery for example. As shown, handle portion 103 may have a tapered shape with a greater thickness near second area 101 with respect to distal end 104 shown in the right portion of the figure. Handle portion 103 may be constructed from any material and may include a grip or alternatively may couple with the inside portion of a grip that is situated around handle portion 103. A smaller diameter ledge 105 separates the first and second areas. Alternatively, the ledge may extend completely across to separate the first area from the second area. FIG. 1B illustrates second area 101 that holds the motion capture element and battery or alternatively slug weight 1111 as shown in FIG. 1G.

FIG. 1C illustrates an end view of the integrated embodiment of the invention from the narrow end that is generally furthest away from the hands of a user, as shown from distal end 104. First area 102 generally has a diameter configured to fit a standard piece of equipment, for example a golf shaft or tennis racquet, etc. Also shown in the tapered area, i.e., handle portion 103.

FIG. 1D illustrates an end view of the integrated embodiment of the invention from the end configured to house the motion capture element and battery or slug weight. As shown, the diameter of the second area 101 is configured large enough to hold a motion capture element and standard battery or batteries in one or more embodiments. By providing an area in the handle that is preconfigured for a motion capture element, integrated embodiments of the invention may be coupled with a piece of equipment and upgraded in the future to include motion capture elements without any modification to the equipment by removing a slug weight from the second area and replacing it with a motion capture element. In this manner, no physical characteristic of the piece of equipment changes at all if the slug weight is chosen to match the weight of the motion capture element and any other components to be placed in the second area, for example a battery or batteries.

Figure 1E:
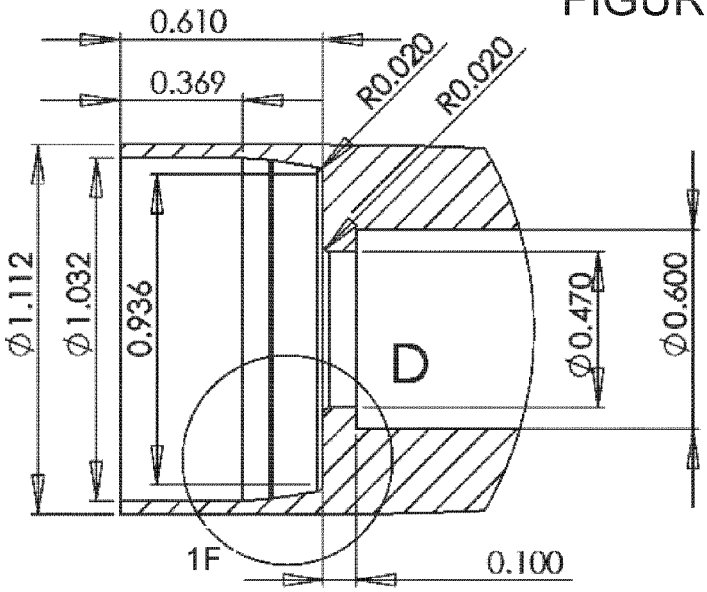
FIG. 1E illustrates a close-up cutaway view of FIG. 1A showing the second area configured as an enclosure to hold a motion capture element and battery or a slug weight of equal weight to the motion capture element and battery for example.

FIG. 1E illustrates a close-up cutaway view of FIG. 1A showing the second area configured as an enclosure to hold a motion capture element and battery or a slug weight of equal weight to the motion capture element and battery for example. Measurements shown in the figure are exemplary and not required. Units are shown in inches.

Figure 1F:
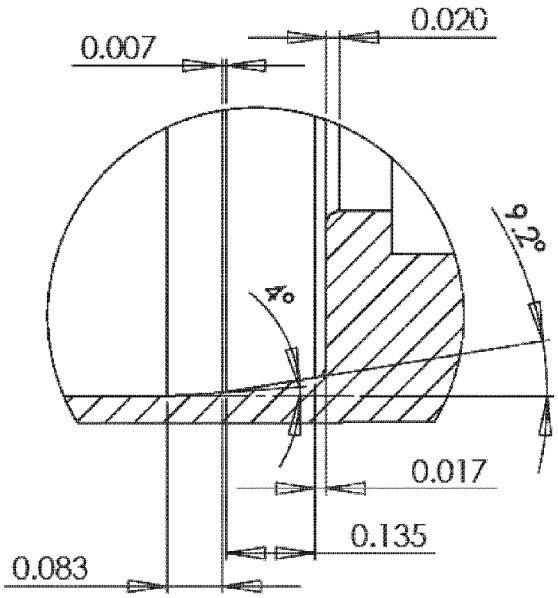
FIG. 1F illustrates a close-up view of a portion of FIG. 1E showing the second area in greater detail.

FIG. 1F illustrates a close-up view of a portion of FIG. 1E showing the second area in greater detail. Tapered and angled areas are optional so long as the first area can hold a motion capture element.

FIG. 1G illustrates a perspective bottom view of slug weight 1111 utilized with integrated and non-integrated embodiments of the invention to maintain an equivalent weight for the piece of equipment. Hence, whether a motion capture element and batteries are installed or replaced with the slug weight for example, the weight and torque characteristics of the piece of equipment may remain unchanged when the piece of equipment is upgraded to include a motion capture element. As shown, slug weight 1111 is situated in the underside of a cap that is configured to enclose second area 101. In one or more embodiments, the cap may include a post or other item to rotationally lock the cap into the first area for example. Threads or any other coupling element may be utilized to hold the cap with an embodiment of the invention.

Figure 2:
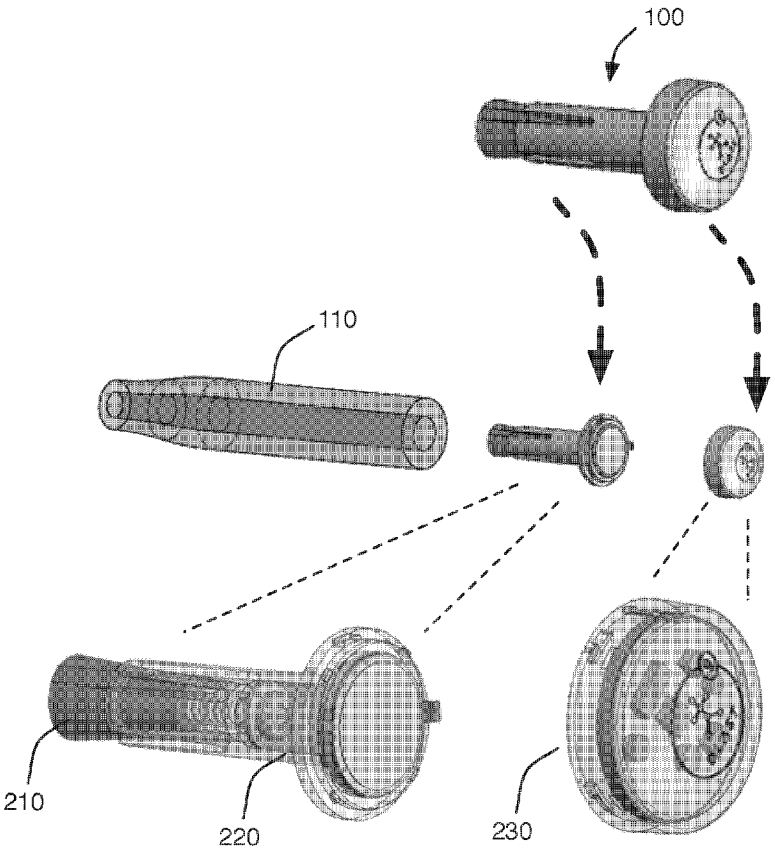
FIG. 2 illustrates a non-integrated embodiment of the invention broken into an exploded view of the main components along with the golf club shaft handle and blow up views of the major components in transparent shading.

FIG. 2 illustrates a non-integrated embodiment of the invention broken into an exploded view of the main components along with the golf club shaft handle and blow up views of the major components in transparent shading. One or more embodiments of the mount include shaft enclosure 220 and expander 210 that may be coupled with an attachment mechanism, for example a screw aligned along an axis parallel to the axis of the golf club shaft. The shaft enclosure and expander are situated within the handle portion of a golf club, i.e., golf club shaft 110. In one or more embodiments, the screw is then rotated to move the shaft enclosure towards the expander, which thus forces legs of the shaft enclosure in a direction orthogonal to the axis of the golf club shaft. The force of the shaft enclosure against the inner wall of the golf club shaft thus couples the shaft enclosure to the golf club shaft based on the coefficient of static friction therebetween. Any other mechanism of coupling the shaft enclosure to a golf club in a non-permanent manner is in keeping with the spirit of the invention. After the shaft enclosure and expander are brought close enough together via the screw to securely couple the mount to the golf club shaft, then either the electronics package or a weight element that may for example weigh the same as the electronics, is coupled with the shaft enclosure. Cap 230 is coupled with the shaft enclosure in either case, which provides a cover for the weight element or electronics package and which may include a visual marker and/or logo on the cap. One or more embodiments of the electronics package are removable to comply with any sporting rules that do not allow instrumented sporting equipment for example. Any other method or structure that enables a non-permanent mount of the apparatus that requires no modification of the golf club shaft is in keeping with the spirit of the invention.

Optionally, an identification element or ID sticker, for example an RFID tag may be mounted within the shaft enclosure, cap, or any other portion of the apparatus, for shot count or club identification functionality. The identification element may also be implemented integral to, or coupled with the PCB in any manner as desired.

If the electronics package is installed, then generally a positive battery contact, printed circuit board or PCB, an insulator or insulative spacer, with negative electrical contact and battery may be installed between the shaft enclosure and cap. Optionally, a wireless antenna and/or GPS antenna may be coupled with the cap or alternatively may be implemented integral to the PCB as desired. Also see FIGS. 3A-C, 4, 4A-D and 9 for more detailed views.

Figures 3A, 3B, 3C:
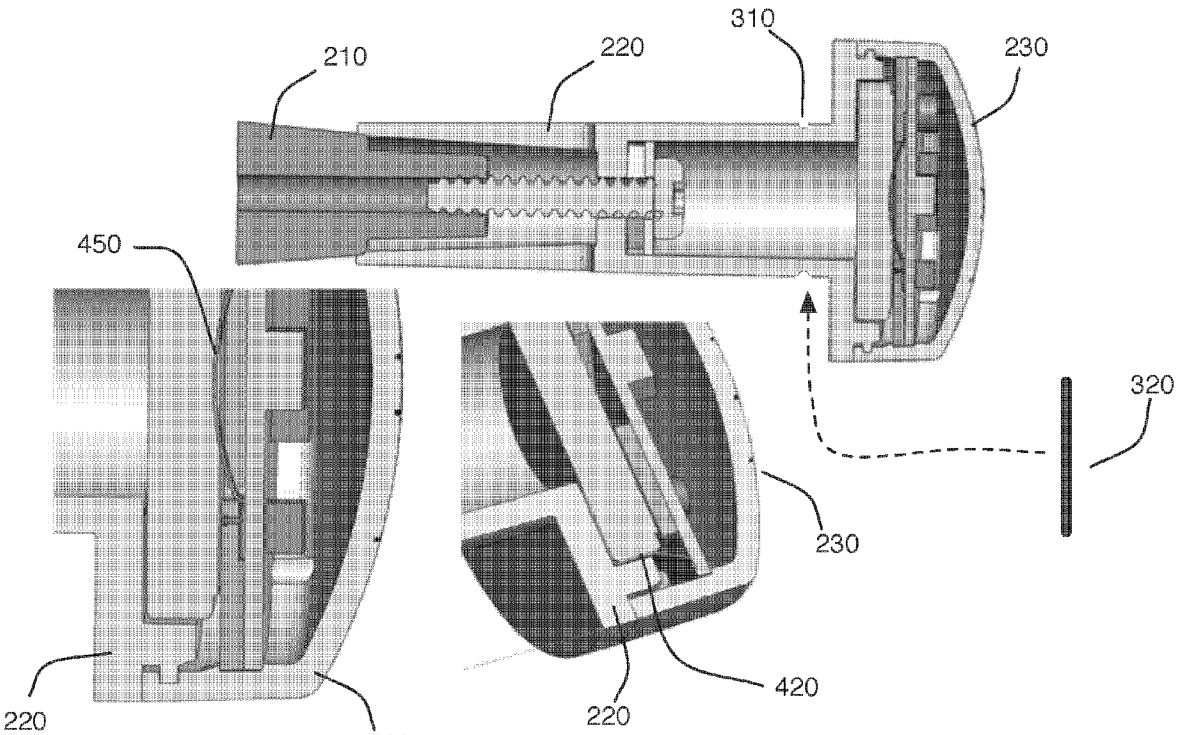
FIG. 3A illustrates a detailed cutaway view of the main components of a non-integrated embodiment of the invention.
FIG. 3B illustrates a detailed cutaway view showing the negative battery contact, also shown in full in exploded view in FIG. 4.
FIG. 3C illustrates a detailed cutaway view showing the positive battery contact, also shown in full in exploded view in FIG. 4.

FIG. 3A illustrates a detailed cutaway view of the main components of an embodiment of the invention, specifically expander 210, shaft enclosure 220 and cap 230. FIG. 3B illustrates a detailed cutaway view showing negative battery contact 450, also shown in full in exploded view in FIG. 4. FIG. 3C illustrates a detailed cutaway view showing positive battery contact 420, also shown in full in exploded view in FIG. 4. Optional O-ring indentation 310 on shaft enclosure 220 provides a potential well for O-ring 320 to be located. Different size O-rings may be utilized to provide a secure fit on the end of shaft enclosure 220 on the end near cap 230.

Figure 4:
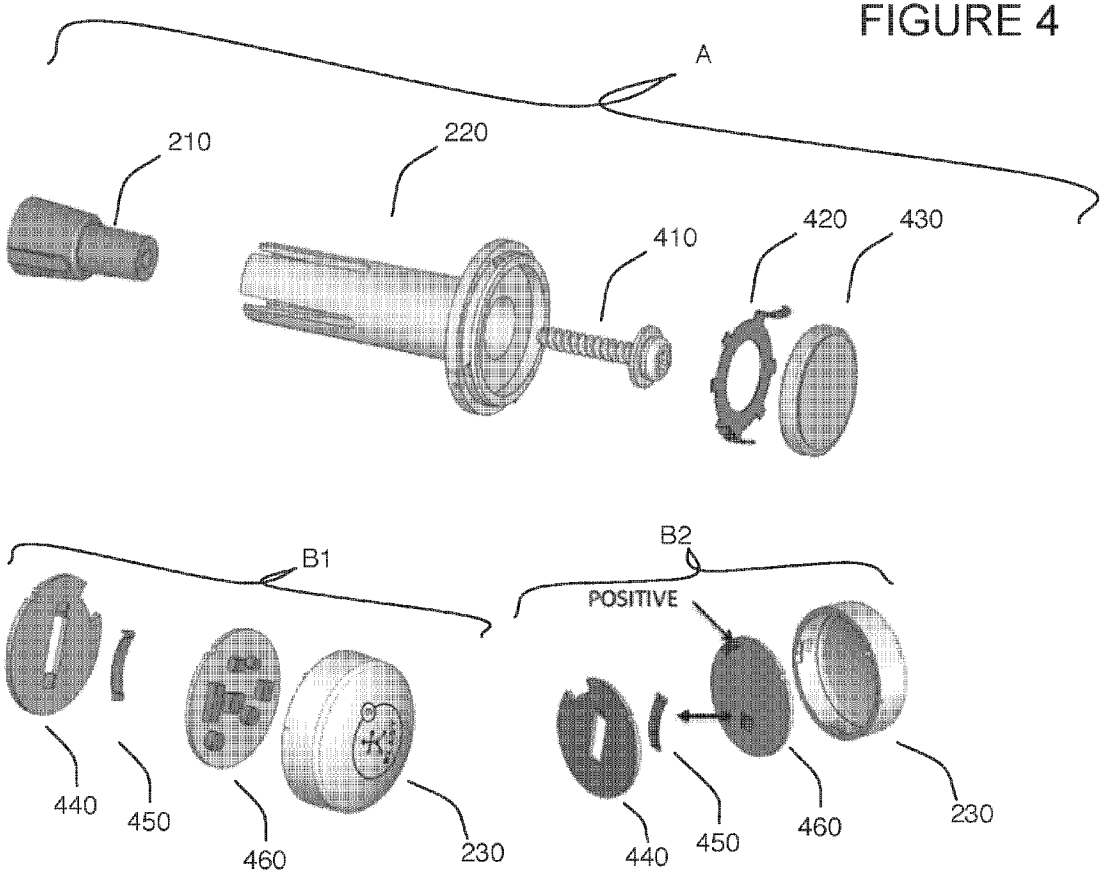
FIG. 4 illustrates an exploded view "A" of the main mount components of a non-integrated embodiment along with the positive battery contact and battery, while view "B1" shows a top oriented view of the insulator, negative battery contact, electronics package, here a printed circuit board or PCB and cap, while view "B2" shows a bottom oriented view of the same components shown in view "B1".

FIG. 4 illustrates an exploded view "A" of the main mount components of a non-integrated embodiment, namely expander 210, shaft enclosure 220 along with screw 410, positive battery contact 420 and battery 430, while view "B1" shows a top oriented view of the insulator 440, negative battery contact 450, electronics package 460, here a printed circuit board or PCB and cap 230, while view "B2" shows a bottom oriented view of the same components shown in view "B1". The left portion of shaft enclosure 220 shows extensions or "legs" that allow for the shaft enclosure to radially expand when expander 210 is pulled along the axis shown by screw 410, when screw 410 is rotated. To keep expander 210 from simply rotating when screw 410 is rotated, expander 210 may include a protrusion (shown on the left side of the expander) that aligns in a slot formed by two of the shaft enclosure's legs. In this manner, expander 210 is pulled along the axis of the screw without rotating along that axis. Electronics package 460 for example may include active motion capture electronics that are battery powered, passive or active shot count components, for example a passive or active RFID tag, which for example may be coupled with electronics package 460 or for example coupled with insulator 440. In addition, a GPS antenna may also be coupled with electronics package 460 or cap 230 (see FIG. 9A). Embodiments of the electronics may include motion capture accelerometers and/or gyroscopes and/or an inertial measurement unit along with wireless transmitter/receiver or transceiver components. The RFID tag enables golf shots for each club associated with a golfer to be counted. The RFID tag may be coupled with any component shown as RFID tags are tiny, for example cap 230 or shaft enclosure 220 or electronics package 460, or any other element. Golf shots may optionally be counted via an identifier associated with motion capture electronics on the golf club in conjunction with a mobile computer, for example an IPHONE® equipped with an RFID reader that concentrates the processing for golf shot counting on the mobile computer instead of on each golf club.

The visual marker may be mounted on cap 230, shown as a circle with dots in view B1 may be utilized with visual motion capture cameras. A golf club number may also be displayed on in a display area of the cap to indicate which club number is associated with the golf club, which is shown as a small circle with a number in it in view B1. Embodiments of the visual marker may be passive or active, meaning that they may either have a visual portion that is visually trackable or may include a light emitting element such as a light emitting diode (LED) that allows for image tracking in low light conditions respectively. This for example may be implemented with a graphical symbol or colored marker at the cap of the mount on the shaft at the end of the handle for example. Motion analysis may be performed externally, for example using a camera and computer system based on the visual marker in any captured images. The visual data may also be utilized in motion analysis in combination with any wireless data from electronics package 460.

Figure 4A:
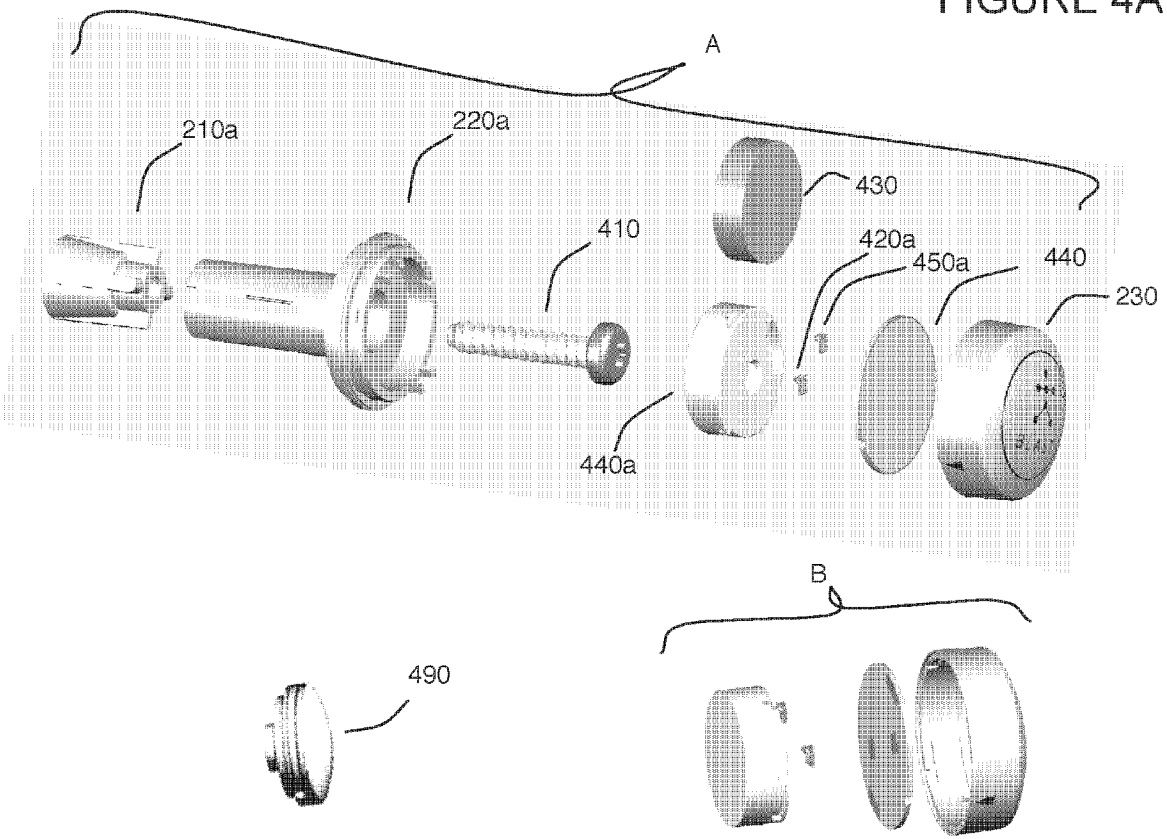
FIG. 4A illustrates an exploded view "A" of the main mount components of a second non-integrated embodiment of the invention along with the positive and negative battery contact and battery, while view "B" shows a bottom oriented view of the insulator, positive and negative battery contact, electronics package, here a printed circuit board or PCB and cap.

FIG. 4A illustrates an exploded view "A" of the main mount components of a second embodiment non-integrated embodiment of the invention, namely expander 210*a*, with ribs slightly offset with respect to expander 210 of FIG. 4. In addition, FIG. 4A also shows a second embodiment of shaft enclosure 220*a* having coupling elements that enable second embodiment of insulator 440*a* to securely couple to shaft enclosure 220*a* without falling out if the mount is turned upside down for example. In this embodiment, insulator 440*a* holds battery 430 inside while providing access to the battery so that positive battery contact 420*a* and negative battery contact 450*a* can make electrical contact with battery 430. View "B" shows a bottom-oriented view of the insulator, positive and negative battery contact, electronics package, here a printed circuit board or PCB and cap. Weight element 490 can be any shape so long as weight element 490 fits within, or couples in any direct or indirect manner with shaft enclosure 220 or 220*a* and cap 230 for example. Weight element or slug weight 490 (see also FIG. 1G for an embodiment integrated with a cap) can be made to weigh as near as desired to the weight of the components that it replaces, for example to comply with any sporting rules that do not allow instrumented sporting equipment, e.g., during competition. Weight element 490 can also be utilized with the embodiment shown in FIG. 4 as one skilled in the art will appreciate.

Figure 4B:
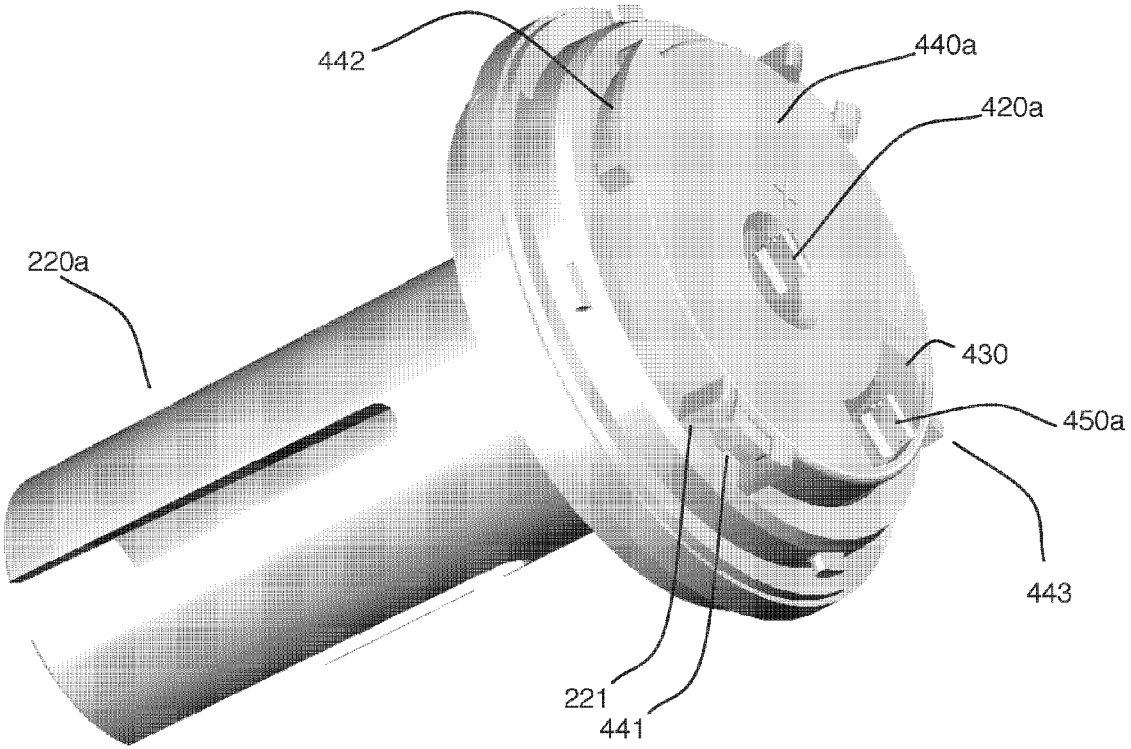
FIG. 4B illustrates a perspective view of the shaft enclosure and insulator of a second non-integrated embodiment of the invention along with the positive and negative battery contact and battery.

FIG. 4B illustrates a perspective view of shaft enclosure 220*a* and insulator 440*a* of the second non-integrated embodiment of the invention of FIG. 4A along with the positive and negative battery contact 420*a* and 450*a* respectively (situated above holes in insulator 440*a*) along with battery 430 that is internally held within insulator 440*a*. Insulator 440*a* includes for example snap components, e.g., coupling elements 441 that couple with coupling elements 221 of shaft enclosure 220*a* so that insulator 440*a* and hence battery 430 do not fall out when the cap is removed. To remove insulator 440*a* and hence battery 430, tab 442 may be engaged with for example a finger, screw driver or other implement to disengage coupling elements 441 from coupling elements 221. Alignment component 443 enables rotational alignment of the insulator with the shaft enclosure.

Figure 4C:
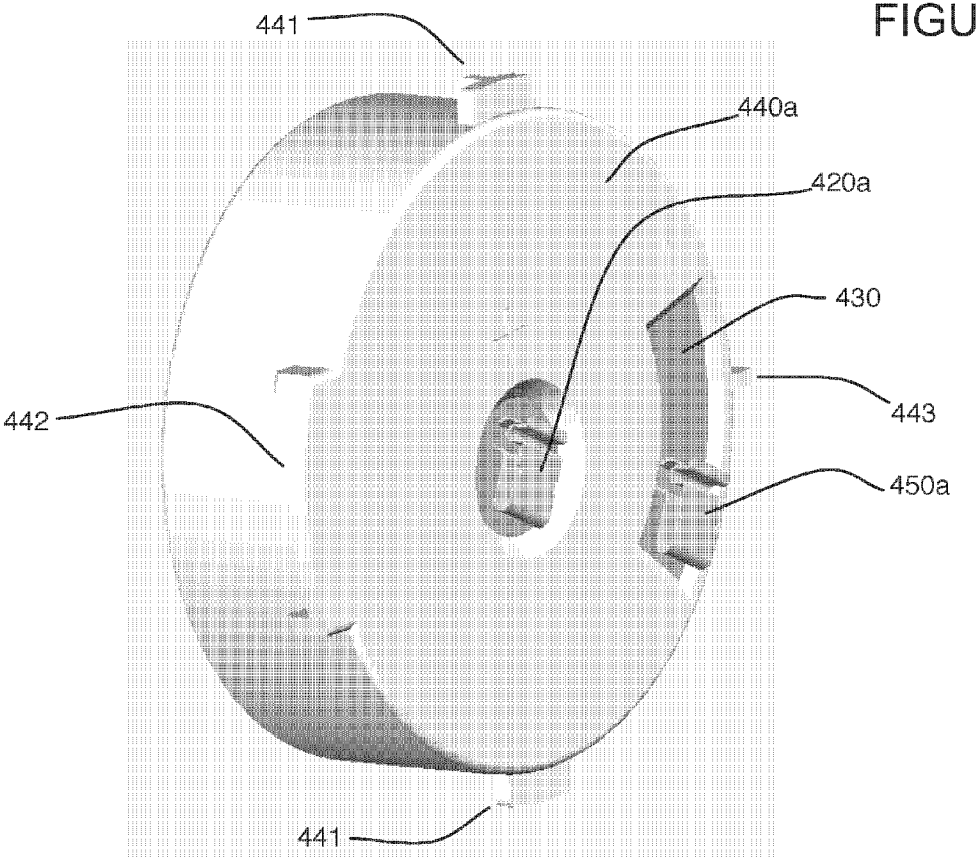
FIG. 4C illustrates a perspective view of the insulator along with the positive and negative battery contact and battery.

FIG. 4C illustrates a perspective view of the insulator along with the positive and negative battery contact 420*a* and 450*a* respectively, and battery 430. Coupling elements 441 are shown on the top and bottom in the written page, however any type of coupling element may be utilized in keeping with the spirit of the invention as desired.

Figure 4D:
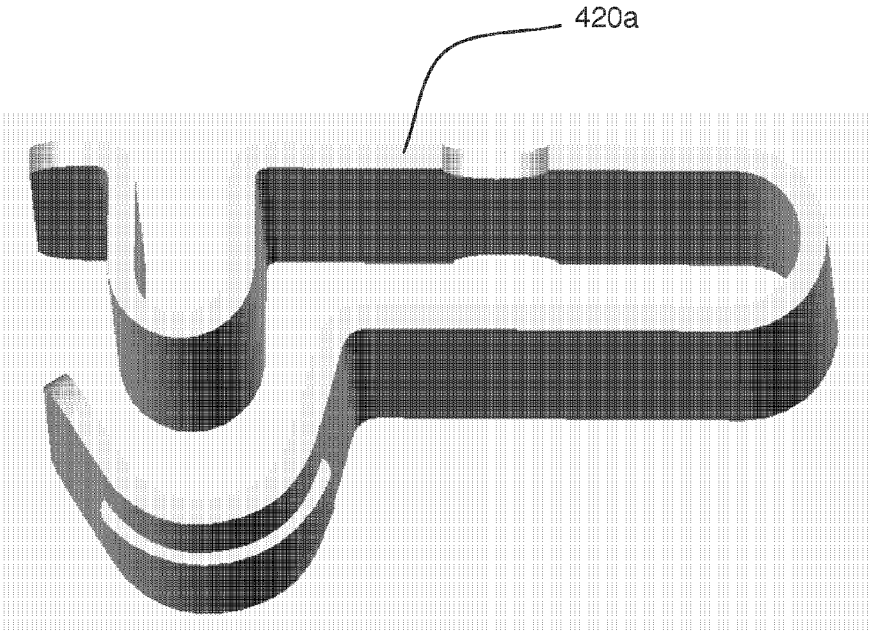
FIG. 4D illustrates a perspective close-up view of the positive battery contact.

FIG. 4D illustrates a perspective close-up view of positive battery contact 420*a*. In one or more embodiments of the invention, the positive and negative battery contacts may utilize the same structure. Any type of positive and negative battery contacts may be utilized so long as they maintain electric connection between the battery and electronics package.

Figure 4E:
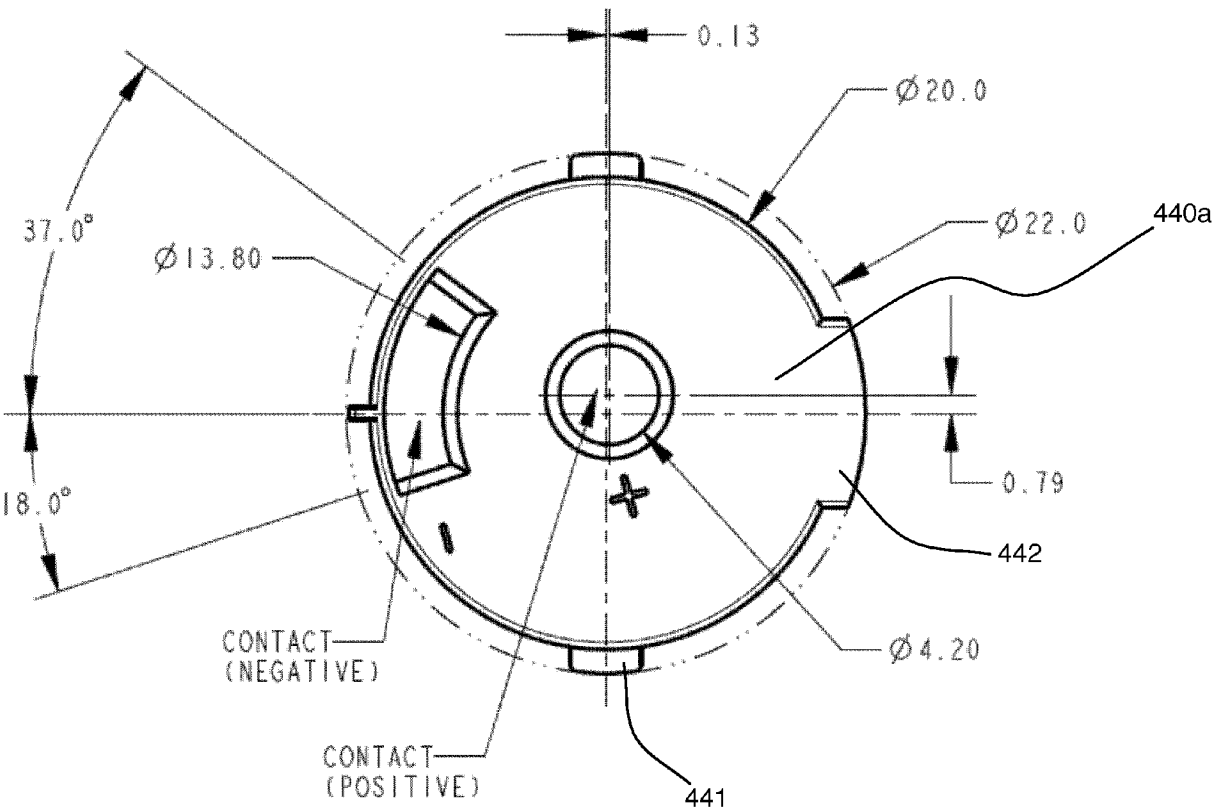
FIG. 4E illustrates a top view of an embodiment of the insulator that is configured to house a battery along with specific exemplary dimensions.

FIG. 4E illustrates a top view of an embodiment of insulator 440*a* that is configured to house a battery along with specific exemplary dimensions. To remove insulator 440*a* and hence the battery within insulator 440*a*, tab 442 may be engaged with for example a finger, screw driver or other implement to disengage coupling elements 441 from the coupling elements shown for example in FIG. 4B. In this figure, the numbers represent millimeters, and angle tolerances are within 2 degrees. As shown, this embodiment of insulator 440*a* is configured to house a 6.4 mm battery. Although not required for distribution in some countries, one or more embodiments of insulator 440*a* may be constructed to be compliant with EU Directive 2002/95/EC (RoHS) and EU Directive 2002/96/EC (WEEE). Embodiments may alternatively be constructed to be compliant with any other electrical or manufacturing standards as desired.

Figure 4G:
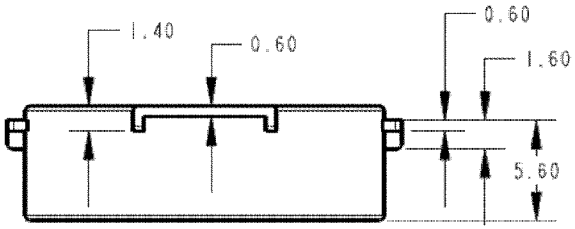
FIG. 4G illustrates a second side of the embodiment of the insulator of FIG. 4E.
Figure 4I:
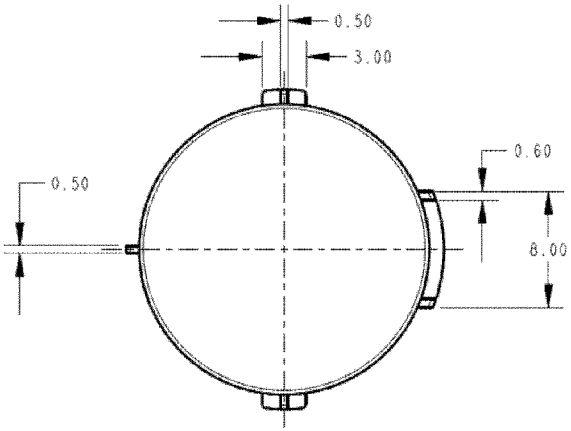
FIG. 4I illustrates a bottom view of the embodiment of the insulator of FIG. 4E.
Figure 4F:
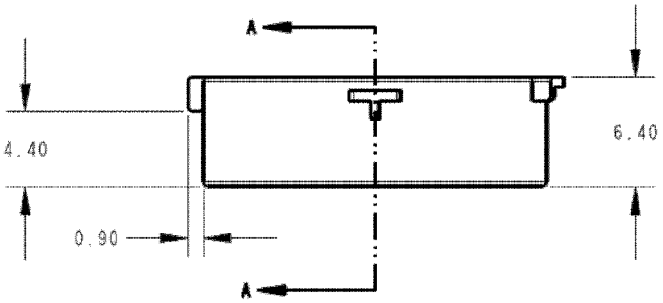
FIG. 4F illustrates a first side of the embodiment of the insulator of FIG. 4E.
Figure 4H:
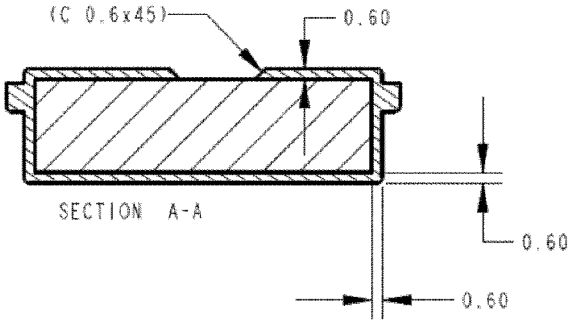
FIG. 4H illustrates a cross section view "A" of FIG. 4F.

FIG. 4F illustrates a first side of the embodiment of the insulator of FIG. 4E. See also FIG. 4H for the cross section view. FIG. 4G illustrates a second side of the embodiment of the insulator of FIG. 4E. FIG. 4H illustrates a cross section view "A" of FIG. 4F. FIG. 41 illustrates a bottom view of the embodiment of the insulator of FIG. 4E.

Figure 4J:
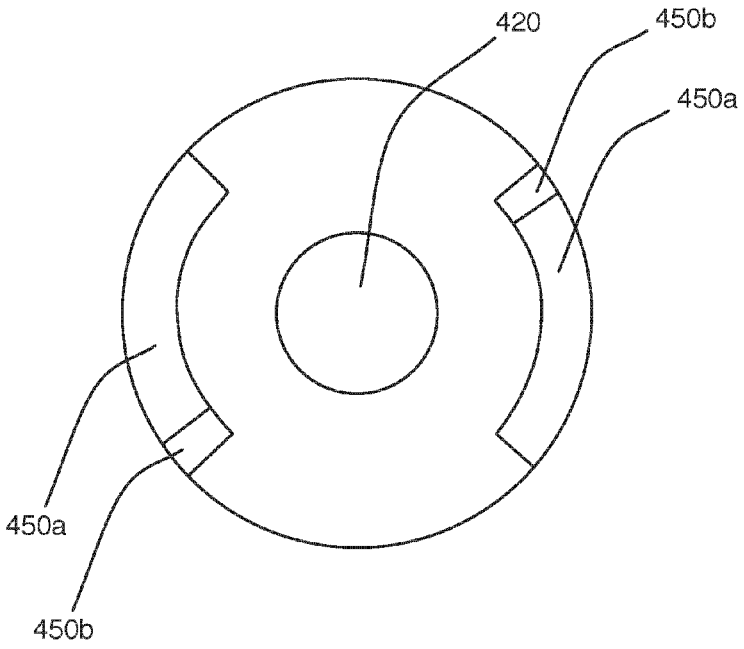
FIG. 4J illustrates a top view of an embodiment of the double battery assembly.

FIG. 4J illustrates a top view of an embodiment of the double battery assembly. As shown, positive contact 420 is situated in the center of the top of the assembly (see also FIG. 4E for another embodiment). In the instant embodiment, there are two negative contacts 450*a* and a non-contact area 450*b* that provides no connection to the negative battery supply. In this manner, rotation of the cap with corresponding positive and negative contacts enables connecting and disconnecting the electronics to the negative battery terminal and thus enables turning the motion capture element electronics on and off.

Figure 4K:
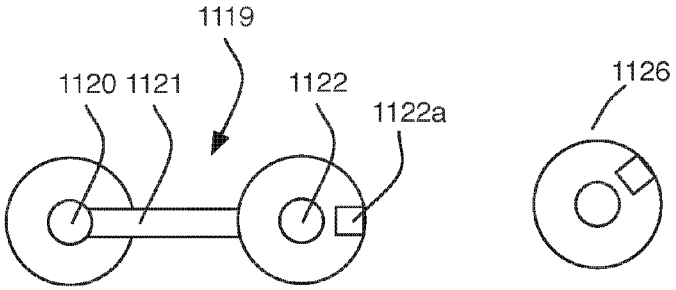
FIG. 4K illustrates and embodiment of a multiple battery arrangement wherein a plurality of batteries may be coupled in parallel and still be arranged physically on top of one another.
Figure 4L:
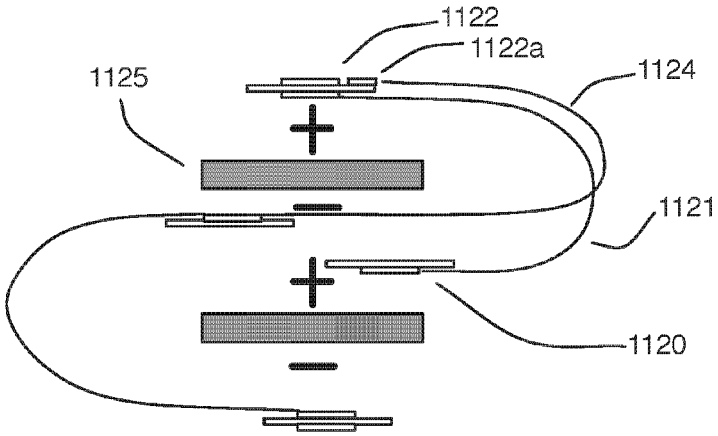
FIG. 4L illustrates a side logical view of an embodiment of the multiple battery arrangement.

FIG. 4K illustrates and embodiment of a multiple battery arrangement wherein a plurality of batteries may be coupled in parallel and still be arranged physically on top of one another. FIG. 4L illustrates a side logical view of an embodiment of the multiple battery arrangement. Batteries 1125 (of which two are shown from side view on top of one another) as shown in the lower portion of the figure are coupled in parallel using battery coupler 1119. Battery coupler 1119 includes a pass-thru connector 1122 on each side of an insulating circular element that is coupled with an insulated conductor 1121 to another insulating circular element having a single sided connector 1120. Optional opposing polarity pad 1122*a* may also be located on the first circular element to allow for rotating cap 1126 to make contact with elements 1122 and 1122*a* when rotated into the on position thereby making contact with both elements. As shown in the lower part of the figure, two battery couplers 1119 are wrapped around respective batteries wherein the pass-thru connectors are on opposing sides of the pair of batteries, while the single sided connectors 1120 are situated pointing away from one another to insulate the respective poles from one another in the inner portion of the battery pair. Wire 1124 may also be utilized to provide a contact to element 1122*a* if desired, in which case the bottom pass thru contact of shown in the bottom of the figure may be implemented as one sided, i.e., if both positive and negative are to brought to the top of the stack at 1122 and 1122*a* respectively. This enables standard coin batteries to be utilized in parallel to double, or multiply the capacity by N if more battery couplers 1119 are utilized, so that N batteries in parallel for example. Two of such embodiments along with wire 1124 may be formed in a combined package for example as is shown in FIG. 4M.

Figure 4M:
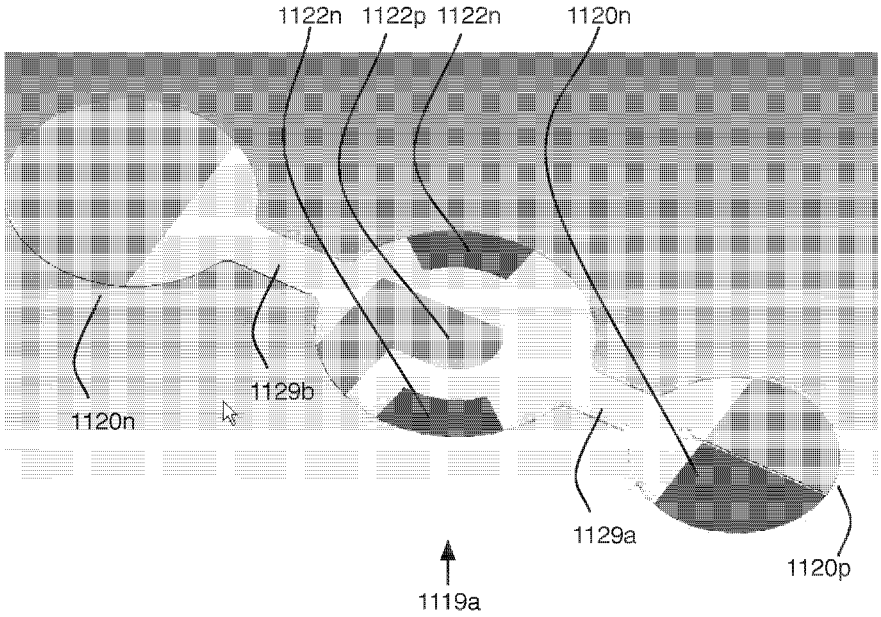
FIG. 4M illustrates a perspective view of an embodiment of the electrical connector utilized to implement a dual battery arrangement.

FIG. 4M illustrates a perspective view of an embodiment of the electrical connector utilized to implement a dual battery arrangement. This embodiment effectively includes two of the embodiments shown in FIG. 4K along with wire 1124 in one integrated assembly. As shown, the embodiment includes three generally circular "pads" coupled with short interconnect 1129*a* and long interconnect 1129*b* respective. In one embodiment, positive contact 1122*p* is a pass through from the underside of the center pad and also couples with the top of contact 1120*p*. These paths provide a connection to the positive electrical terminal of two batteries. Negative contacts 1122*n* couple electrically to the bottom of the left pad 1120*n* and top of the right pad 1120*n*. Although the wires connecting the various are not shown for brevity, their logical paths may be implemented in any desired manner as shown in FIG. 4L, for example using wires or any other conducting elements such as conductive tape or any other conducting object.

Figure 4N:
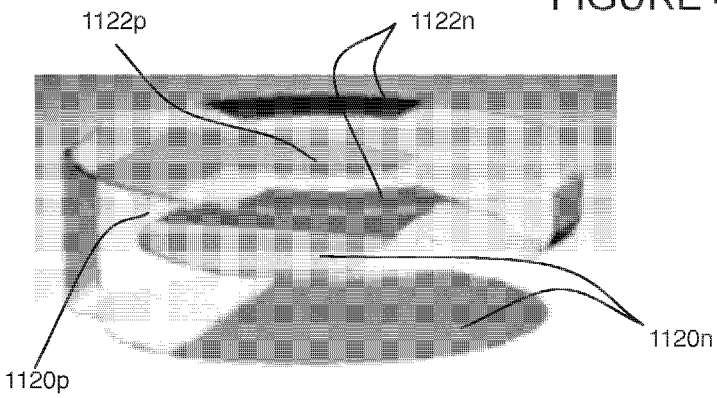
FIG. 4N illustrates a perspective view of the embodiment of the electrical connector of FIG. 4M in the folded configuration.

FIG. 4N illustrates a perspective view of the embodiment of the electrical connector of FIG. 4M in the folded configuration. As shown, contacts 1120*n* are configured to touch the bottoms of two batteries that are situated in the void areas between the folded pads. See also FIG. 4W. Contact 1120*p* is configured to touch the top of the lower battery, i.e., the underside of the folded pad contacts the battery and is insulated from the negative contact 1120*n* on the middle folded pad. As one skilled in the art will appreciate, any type of electrical path from the middle folded pad at contact 1120*p* that may travel for example up the short interconnect on the right of the figure and for example that connects electrically to positive contact 1122*p* is in keeping with the spirit of the invention. Likewise, the negative contacts may electrically connect to the negative contacts 1122*n* by providing an electrical connection up the long and short interconnects. The negative contacts 1122*n* on the top pad may be electrically connected or not as desired wherein the electrical connection to both negative contacts may be provided directly on the PCB of the motion capture element for example.

Figure 4P:
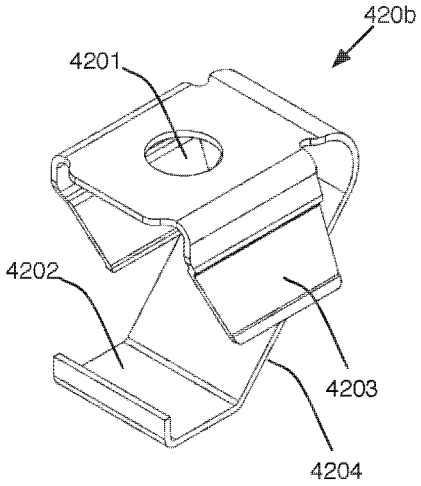
FIG. 4P illustrates a perspective view of an embodiment of a high impact contact configured to maintain electrical connection between a PCB and associated positive or negative battery contact under high G forces.

FIG. 4P illustrates a perspective view of an embodiment of a high impact contact configured to maintain electrical connection between a PCB and associated positive or negative battery contact under high G forces.

Figure 4Q:
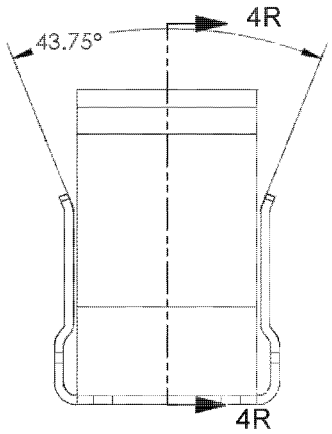
FIG. 4Q illustrates a upside down front view of an embodiment of a high impact contact.
Figure 4R:
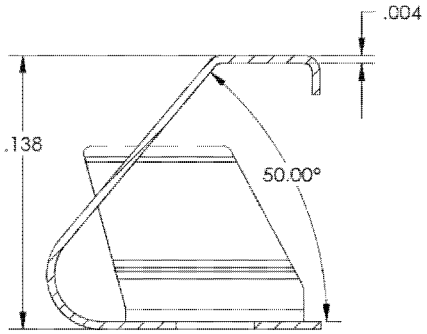
FIG. 4R illustrates a cutaway view of an embodiment of the high impact contact of FIG. 4Q.
Figure 4S:
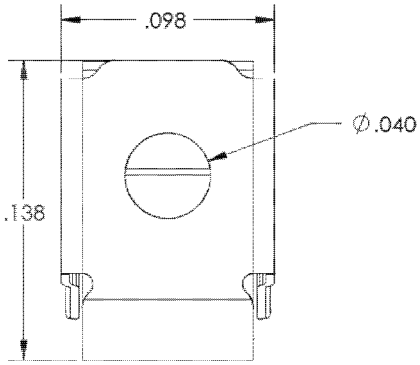
FIG. 4S illustrates a top view of an embodiment of a high impact contact of FIG. 4P.

FIG. 4Q illustrates a upside down front view of an embodiment of a high impact contact. One or more embodiments of the high impact contact may couple with the PCB via a solder point using hole 4201 for example. Flanges 4203 may extend downward from the area having the hole and angled area 4204 couples the top area having the hole to the lower contact 4202. Although the figures show angles and thicknesses, these are exemplary. One or more embodiments may be made from any conductive material, such as stainless steel for example. FIG. 4R illustrates a cutaway view of an embodiment of the high impact contact of FIG. 4Q. FIG. 4S illustrates a top view of an embodiment of a high impact contact of FIG. 4P.

Figure 4T:
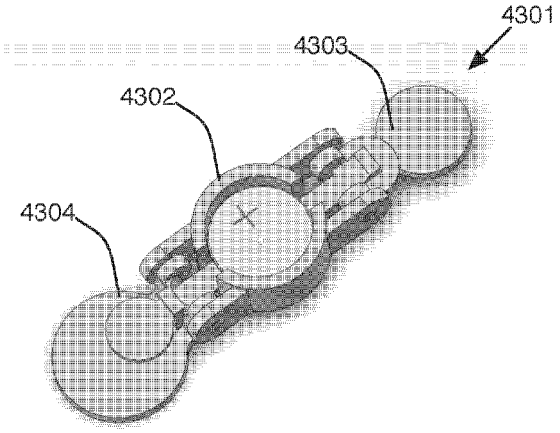
FIG. 4T illustrates an embodiment of a tool utilized to fold the electrical connection of FIG. 4M into the folded position shown in FIG. 4N.
Figure 4U:
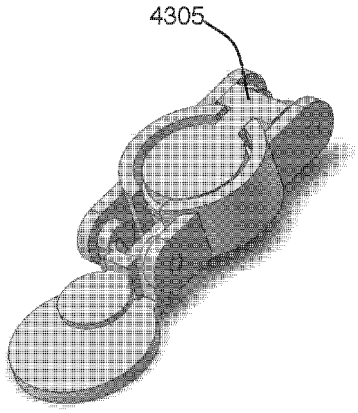
FIG. 4U illustrates the embodiment of the tool of FIG. 4T with the short tab folded.

FIG. 4T illustrates an embodiment of tool 4301 utilized to fold the electrical connection of FIG. 4M into the folded position shown in FIG. 4N. The tool includes a body 4302 configured to hold two batteries and a short rotating pad compressor 4303 and long rotating pad compressor 4304. The body has two slots to enable the interconnections between pads as shown in FIG. 4M to fit through to the pad compressors. The three pad contact of FIG. 4M is inserted into the tool wherein the outer pads are placed over the pad compressors and the central pad is placed in the body. This is not shown for brevity. The first battery is then placed within body 4302 negative side down. The battery is shown with "+" sign indicates positive side up. The short rotating pad compressor 4303 is rotated to bend a pad over the first battery as shown in FIG. 4U, wherein the axial length of arm 4305 is short. Then the short rotating pad compressor 4303 is unfolded and a second battery is inserted into the body and the long rotating pad compressor 4304 is folded over the pad having the longer interconnect as shown in FIG. 4V.

Figure 4V:
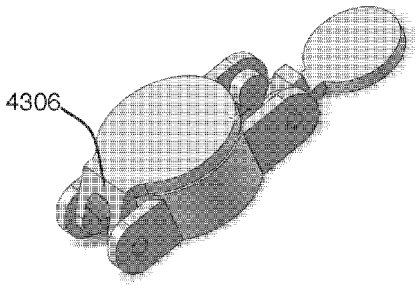
FIG. 4V illustrates the embodiment of the tool of FIG. 4T with the long tab folded.
Figure 4W:
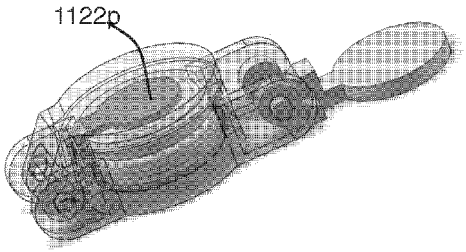
FIG. 4W illustrates a shaded partially transparent side perspective view of an embodiment of the tool as shown in FIG. 4V.

FIG. 4W illustrates a shaded partially transparent side perspective view of an embodiment of the tool as shown in FIG. 4V. As shown, positive contact 1122*p* is visible on top of the upper battery. The folded electrical connector of FIG. 4N results.

Figure 5:
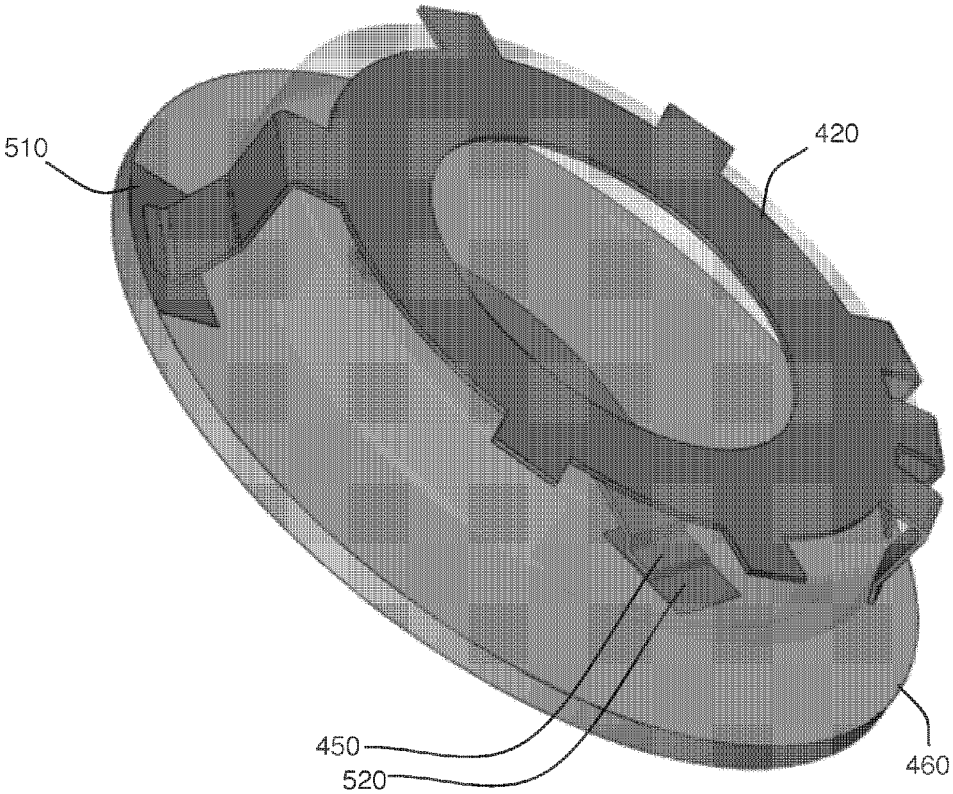
FIG. 5 illustrates a close up perspective view of the PCB and associated positive and negative contacts that are configured to make an electrical connection with the positive battery contact and the negative battery contact respectively.

FIG. 5 illustrates a close up perspective view of the electronics package 460 or PCB and associated positive contact 510 and negative contact 520 that are configured to make an electrical connection with the positive battery contact 420 and the negative battery contact 450 respectively. See also FIG. 4 for an exploded view of the relative positioning of the components shown in this figure.

Figure 5A:
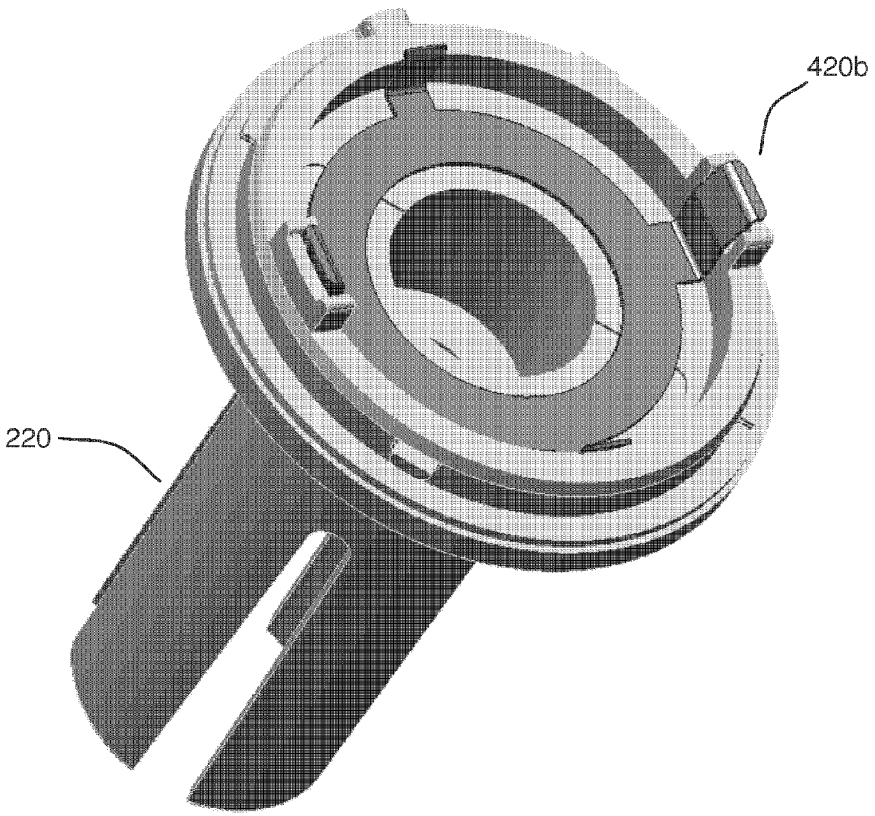
FIG. 5A illustrates a second embodiment of the positive battery contact located in the non-integrated embodiment of the shaft enclosure.

FIG. 5A illustrates a second embodiment of positive battery contact 420*b* located in the non-integrated embodiment of the shaft enclosure. This embodiment is symmetrical in that there are two opposing sets of upward projections from the base plane that contacts shaft enclosure 220. One of the opposing sets of upward projections of positive battery contact 420*b* are slightly wider and are positioned within areas on shaft enclosure 220 to allow for radially aligning positive battery contact 420*b* with respect to shaft enclosure 220.

Figure 6:
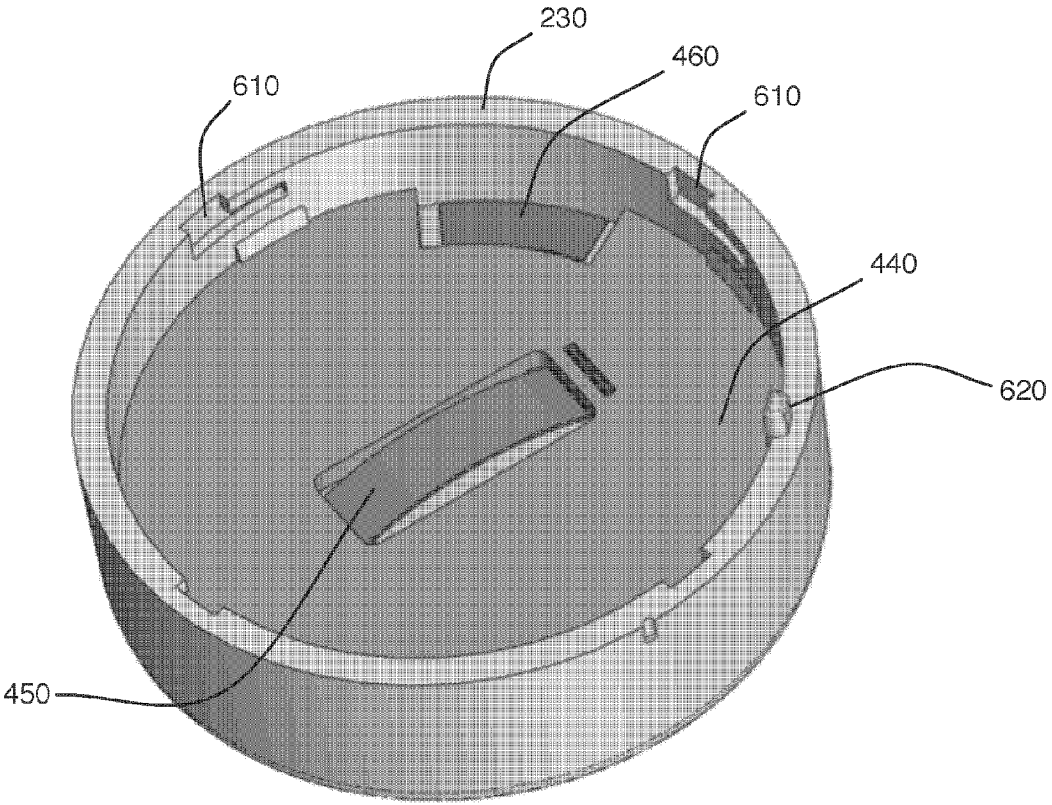
FIG. 6 illustrates a close up perspective view of the cap with PCB and negative battery contact showing along with a coupling element, here four coupling points, and alignment element.

FIG. 6 illustrates a close up perspective view of cap 230 with electronics package 460 or PCB and negative battery contact 450 coupled with insulator 440 showing along with a coupling element, here four coupling points 610 (with only the top two shown with reference number 610 with the inside portions visible, while the opposing two have only the initial slot openings in the cap visible), and alignment element 620.

Figure 6A:
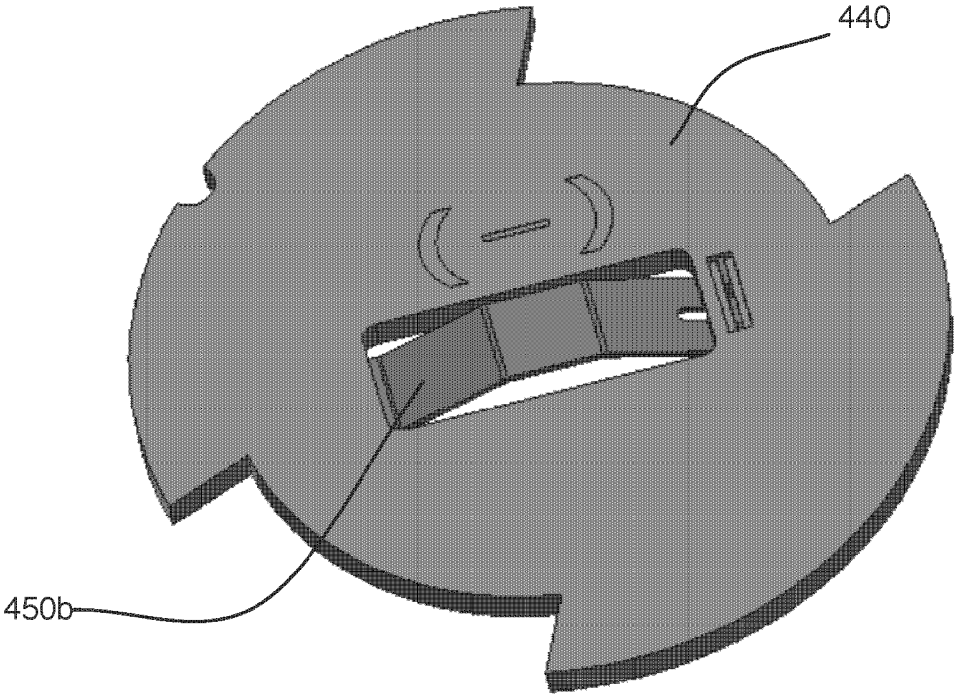
FIG. 6A illustrates a second embodiment of the negative batter contact having faceted surfaces as shown from the bottom side of the insulator.
Figure 6B:
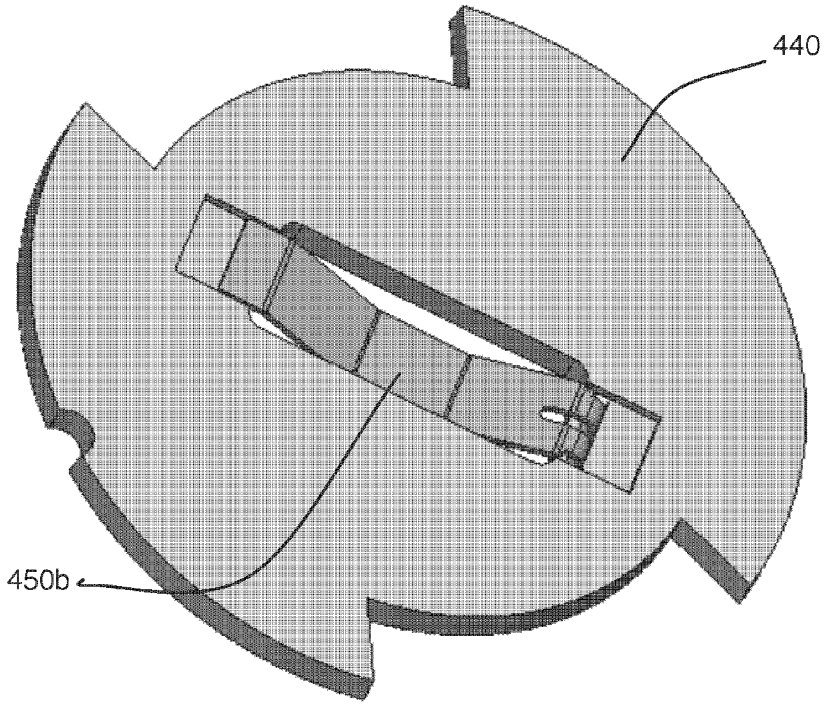
FIG. 6B illustrates the embodiment of FIG. 6A as shown from the top side of the insulator.

FIG. 6A illustrates a second embodiment of the negative battery contact 450*b* having faceted surfaces as shown from the bottom side of insulator 440. FIG. 6B illustrates the embodiment of FIG. 6A as shown from the top side of the insulator. The right portion of negative battery contact 450*b* as shown may be folded over to engage insulator 440 while the opposing end of negative battery contact 450*b* may freely travel in a slot provided in insulator 440. The slot allows for the negative battery contact 450*b* to flatten, and hence travel in the slot, based on the force generated by placing the battery against negative battery contact 450*b*.

Figure 7:
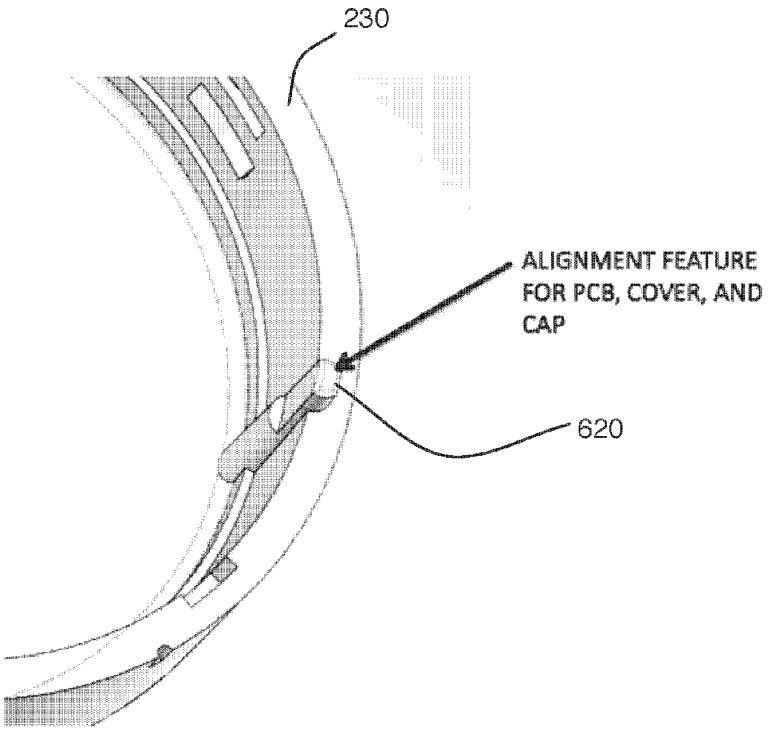
FIG. 7 illustrates a close up perspective view of the cap and alignment element.

FIG. 7 illustrates a close up perspective view of the cap and alignment element. Alignment element 620 allows for the angular alignment of insulator 440, and electronics package 460 that have indents on their sides to engage the alignment element 620. (See FIG. 4). By aligning insulator 440 and electronics package 460 with cap 230, positive battery contact 420 and negative electrical contact 450 are also aligned rotationally since they couple to respective components non-rotationally, for example.

Figure 8:
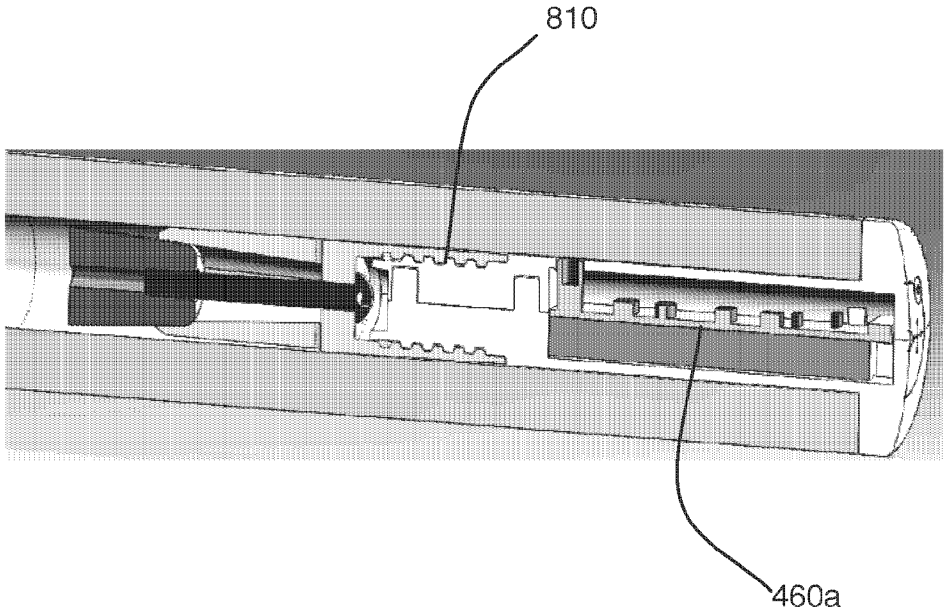
FIG. 8 illustrates a cutaway view of a second embodiment of the electronics package in longitudinal form along with a second embodiment of a non-integrated coupling element.

FIG. 8 illustrates a cutaway view of a second embodiment of electronics package 460*a* in longitudinal form along with a second embodiment of a non-integrated embodiment of the coupling element. Any other orientation of electronics is in keeping with the spirit of the invention so long as the mount is configured to hold the desired electronics package. Embodiments of the invention do not require modifying the golf club, for example to include threads within the shaft. Embodiments of the invention also can be flush mounted with the normal end of a golf club shaft or have any desired low profile extension from a non-instrumented club. Embodiments of the invention generally utilize a mount that is separate from the electronics so that the electronics package can be easily removed and replaced, or so that the battery can be easily removed and replaced, for example without any tools. As shown in this embodiment, a different coupling mechanism is used versus coupling points 610, namely threads 810 that engage shaft enclosure 220, which in this embodiment has corresponding threads.

Figure 9:
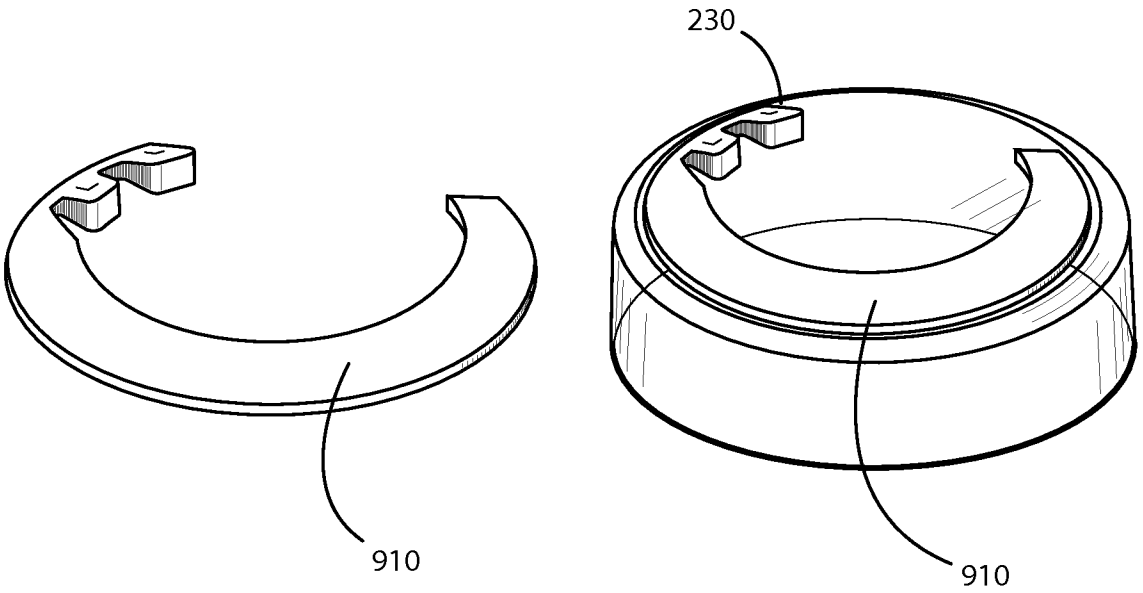
FIG. 9 illustrates an embodiment of a wireless antenna, for example a BLUETOOTH® antenna, configured to mount within the cap.

FIG. 9 illustrates an embodiment of wireless antenna 910, configured to mount within cap 230 as shown in the right portion of the figure. Alternatively, the wireless antenna may be coupled with the electronics package 460 or may include any conductive element in any shape that can radiate electromagnetic energy.

Figure 9A:
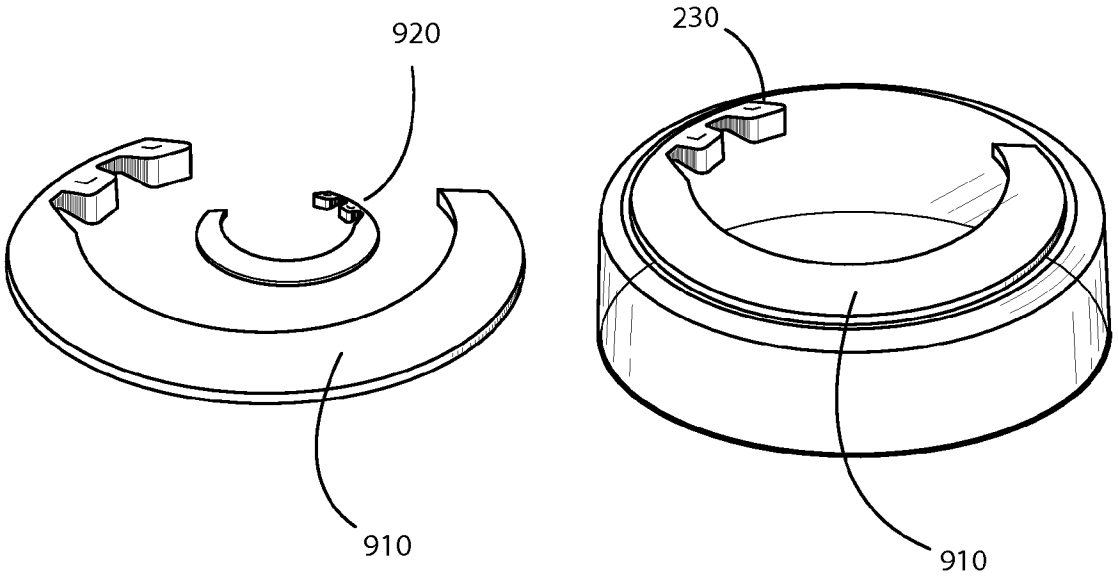
FIG. 9A illustrates an embodiment of the cap having two antennas, a wireless antenna, for example a BLUETOOTH® antenna and a GPS antenna.

FIG. 9A illustrates an embodiment of the cap having two antennas, a wireless antenna, for example a BLUETOOTH® antenna and a GPS antenna 920. The GPS antenna is optional and may be mounted in cap 230 as wireless antenna 910 is, or may be implemented in a different form factor or coupled with the PCB in any direct or indirect manner as one skilled in the art will appreciate.

Figure 10:
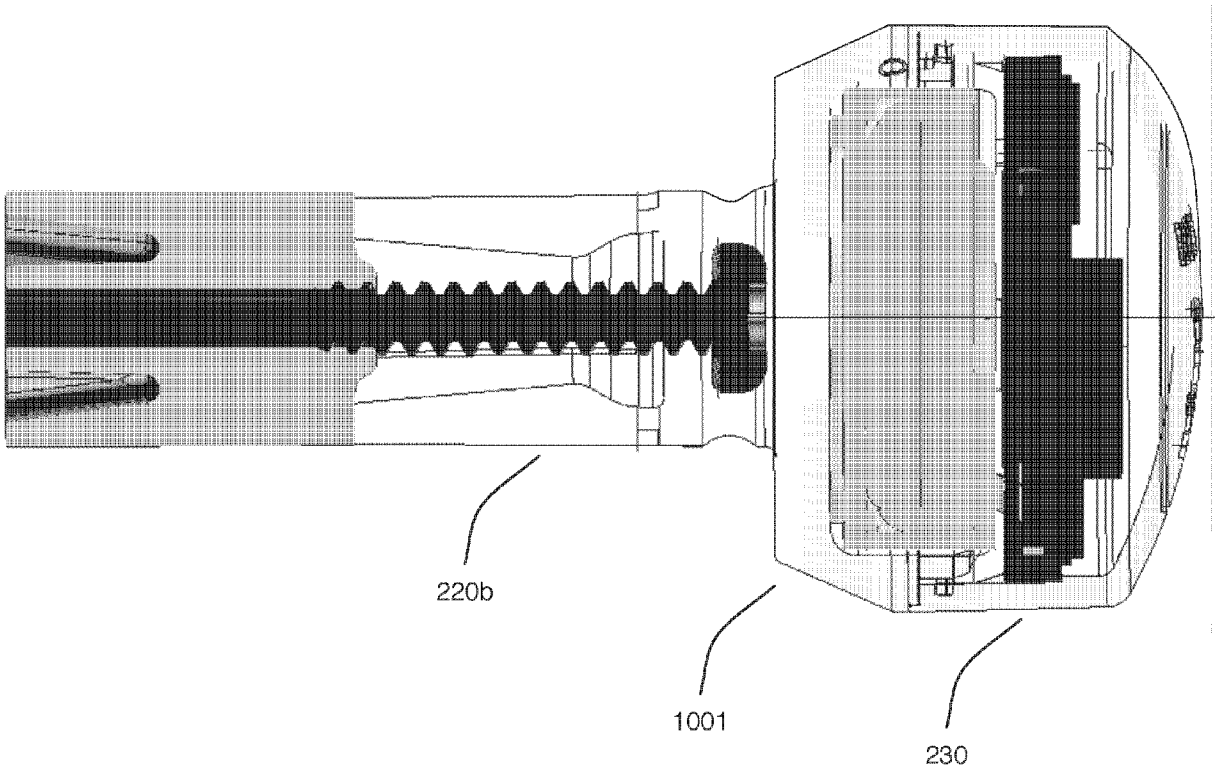
FIG. 10 shows another non-integrated embodiment of the shaft enclosure having an angled area. The shaft enclosure couples with cap as is shown in the right portion of the figure.

FIG. 10 shows a non-integrated embodiment of shaft enclosure 220*b* with angled area 1001. Shaft enclosure 220*b* couples with cap 230 as is shown in the right portion of the figure. Any other embodiment of the shaft enclosure detailed herein may be utilized on a shaft having a grip that either includes a hole or that does not include a hole and that wraps partially or fully around the motion capture element.

Figure 11:
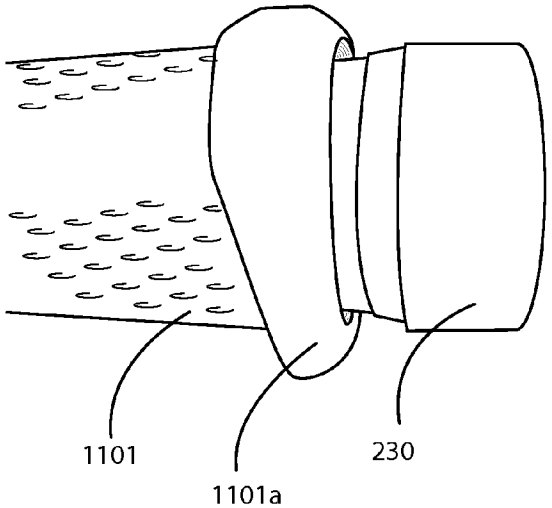
FIG. 11 shows an embodiment of the grip, for example having a hole in the top of the grip that allows for the grip to be rolled down the shaft as is shown and enabling access to the cap without removing the grip from the shaft.

FIG. 11 shows grip 1101, having a hole in the top of the grip that allows for the grip to be rolled down the shaft as is shown at area 1101*a*. This enables cap 230 to be exposed, removed or otherwise accessed without removing the grip from the piece of equipment for example.

Figure 12:
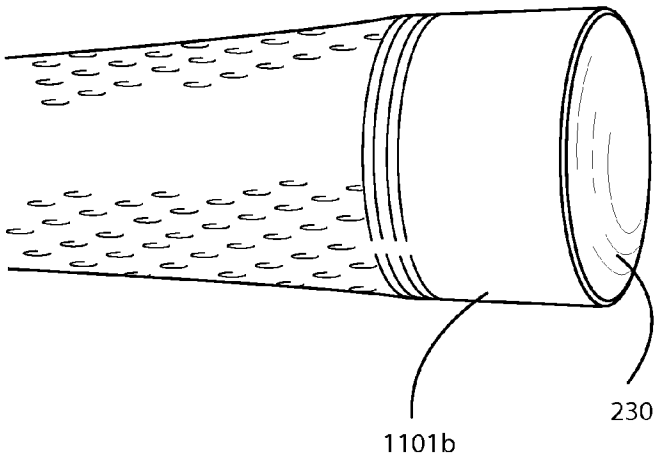
FIG. 12 shows the grip rolled back over the angled area and onto the side portions of the cap. This enables the end of the cap to be seen through the hole in the end of the grip, and enables the grip to provide extra support for the motion capture element.

FIG. 12 shows grip at area 1101*b* rolled back over angled area 1001 and onto the side portions of cap 230. This enables the end of the cap 230 to be seen through the hole in the end of the grip, and enables the grip to provide extra support for the motion capture element.

While the ideas herein disclosed has been described by means of specific embodiments and applications thereof, numerous modifications and variations could be made thereto by those skilled in the art without departing from the scope of the invention set forth in the claims.

What is claimed is:

1. A handle integrated motion capture element mount apparatus comprising: an elongated handle portion having a distal portion and a proximal portion; a first area located within said distal portion of said handle portion wherein said first area is configured to couple with an elongated shaft of a piece of equipment;

a second area located in said proximal portion of said handle portion housing a motion capture element and at least one battery;

a weight element; and, wherein said second area is further configured to internally hold said weight element when said motion capture element is removed, wherein said weight element is substantially equal in weight to said motion capture element to minimize a difference in weight between said motion capture element that is removed, at least one battery and said weight element, to keep a total weight of said handle integrated motion capture element mount apparatus of equal value before said motion capture element is removed and after said motion capture element is removed and replaced by said weight element; and, a cap, wherein said second area is configured to couple with said cap to enclose said second area, wherein said second area and said cap are rotationally coupled and configured to power said motion capture element through rotation of said cap with respect to said second area.

2. The apparatus of claim 1 further comprising a high impact electrical contact coupled with said cap.

3. The apparatus of claim 1 wherein said elongated handle portion is configured to couple with a grip.

4. The apparatus of claim 1 further comprising a grip wherein said elongated handle portion is configured to couple with said grip.

5. The apparatus of claim 1 further comprising a visual marker coupled with said cap.

6. The apparatus of claim 5, wherein said motion capture element comprises a background color on an outside surface of said motion capture element, and wherein said visual marker is located on said outside surface of said motion capture element which comprises a pattern of areas that differ in color from said background color of said outside surface of said cap and wherein said areas that differ in color are configured in a radial orientation with respect to a center of said outer surface that is unique through 360 degrees.

7. The apparatus of claim 1 wherein said motion capture element comprises at least one position, orientation, velocity or acceleration sensor or any combination thereof and an antenna.

8. The apparatus of claim 1 wherein said motion capture element is removable to comply with sporting regulations.

9. The apparatus of claim 1 wherein said equipment is a piece of sporting, exercise or medical rehabilitation equipment, golf club, tennis racquet, weight training bar.

10. The apparatus of claim 1 further comprising:

an identifier coupled with said motion capture element associated with a golf club number.

11. The apparatus of claim 1 further comprising:

an identifier coupled with said motion capture element associated with a golf club number wherein said identifier is passive and is configured to operate without contact with a battery or wherein said identifier is active and is configured to couple with said at least one battery.

12. The apparatus of claim 1 further comprising:

a display area coupled with said cap and configured to display a golf club number.

13. The apparatus of claim 1 further comprising:

a ledge that separates said first area from said second area.

14. The apparatus of claim 1 wherein said first area and said second area comprise cylinders of different diameters and wherein said elongated handle portion comprises a conical shape wherein said distal end has a smaller diameter than said proximal end.

15. The apparatus of claim 1 wherein said at least one battery comprises two batteries and further comprising an electrical connector coupled with said two batteries wherein said electrical connector is configured to electrically couple said batteries in parallel that are situated in a series physical configuration.

16. A handle integrated motion capture element mount apparatus comprising:

an elongated handle portion having a distal portion and a proximal portion;

a first area located within said distal portion of said handle portion wherein said first area is configured to couple with an elongated shaft of a piece of equipment;

a second area located in said proximal portion of said handle portion wherein said second area is configured to house a motion capture element and at least one battery;

wherein said first area and said second area comprise cylinders of different diameters and wherein said elongated handle portion comprises a conical shape wherein said distal end has a smaller diameter than said proximal end;

a cap;

wherein said second area configured to couple with said cap to enclose said second area wherein said second area and said cap are rotationally coupled and configured to power said motion capture element through rotation of said cap with respect to said second area;

a weight element; and, wherein said second area is further configured to internally hold said weight element when said motion capture element is removed, wherein said weight element is substantially equal in weight to said motion capture element to minimize a difference in weight between said motion capture element that is removed, at least one battery and said weight element, to keep a total weight of said handle integrated motion capture element mount apparatus of equal value before said motion capture element is removed and after said motion capture element is removed and replaced by said weight element.

17. The apparatus of claim 16, further comprising a visual marker; wherein said motion capture element comprises a background color on an outside surface of said motion capture element, and wherein said visual marker is located on said outside surface of said motion capture element which comprises a pattern of areas that differ in color from said background color of said outside surface of said cap and wherein said areas that differ in color are configured in a radial orientation with respect to a center of said outer surface that is unique through 360 degrees.

* * * * *